US007326898B2

(12) United States Patent
Dozier

(10) Patent No.: US 7,326,898 B2
(45) Date of Patent: Feb. 5, 2008

(54) METHOD AND APPARATUS FOR CLOSING OR SEVERING A TUBE USING A CONTROLLABLE CLOSURE FORCE

(75) Inventor: John W. Dozier, Woolwich Township, NJ (US)

(73) Assignee: State Technology, Inc., Bridgeport, NJ (US)

( * ) Notice: Subject to any disclaimer, the term of this patent is extended or adjusted under 35 U.S.C. 154(b) by 39 days.

(21) Appl. No.: 10/971,901

(22) Filed: Oct. 22, 2004

(65) Prior Publication Data

US 2006/0037956 A1 Feb. 23, 2006

Related U.S. Application Data

(63) Continuation-in-part of application No. 10/919,579, filed on Aug. 17, 2004.

(51) Int. Cl.
*H05B 6/54* (2006.01)

(52) U.S. Cl. ..... 219/769; 219/777; 219/780; 156/380.3; 156/380.6; 156/69

(58) Field of Classification Search ..... 219/769, 219/765, 777–780, 770, 774, 633; 156/274.4, 156/64, 380.3, 380.4, 380.1, 272.2, 274.6, 156/274.8, 379.6, 380.2, 380.6, 380.7, 380.8, 156/381

See application file for complete search history.

(56) References Cited

U.S. PATENT DOCUMENTS 3,686,463 A * 8/1972 Charlesworth ..... 219/127
3,742,180 A 6/1973 Bradley
3,992,606 A 11/1976 Arutt et al.
4,013,860 A 3/1977 Hosterman et al.
4,186,292 A 1/1980 Acker
4,355,222 A 10/1982 Geithman et al.
4,362,918 A 12/1982 Rabin
4,384,186 A 5/1983 Burt
4,390,832 A 6/1983 Taylor
4,488,028 A 12/1984 Acker et al.
4,491,711 A 1/1985 Acker
4,496,819 A 1/1985 Acker et al.
4,529,859 A 7/1985 Minney et al.
4,610,670 A 9/1986 Spencer
4,954,678 A 9/1990 Harmony et al.
5,256,845 A 10/1993 Schippers (Continued)

FOREIGN PATENT DOCUMENTS

JP 2-62227 * 3/1990

OTHER PUBLICATIONS

Sebra, Tube Sealers, 2000.

*Primary Examiner*—Philip H. Leung
(74) *Attorney, Agent, or Firm*—RatnerPrestia

(57) ABSTRACT

FIG. 1 depicts a full view of the picnic table backrest. It shows the backrest, the bars that wrap around the bench to keep the back rest stable and the latch on the back of the rest that keeps the rest from slipping out. FIG. 2 shows a close up view of the latch on the rear of the backrest. The bar that holds the latch swivels upward to latch on to the top part of the backrest. This keeps the backrest from slipping out and also holds it in place so it doesn't shift while your sitting.

32 Claims, 17 Drawing Sheets

U.S. PATENT DOCUMENTS 5,272,304 A 12/1993 Been et al.
5,278,382 A 1/1994 Rische et al.
5,345,070 A 9/1994 Hlavinka et al.
5,349,166 A 9/1994 Taylor
5,366,580 A 11/1994 Czach
5,374,395 A 12/1994 Robinson et al.
5,543,604 A 8/1996 Taylor
5,710,413 A 1/1998 King et al.
5,750,971 A 5/1998 Taylor
5,855,731 A 1/1999 Spencer
6,139,527 A 10/2000 Laufer et al.
6,213,334 B1 4/2001 Coelho et al.
2003/0168443 A1* 9/2003 Dozier ..... 219/607

* cited by examiner

METHOD AND APPARATUS FOR CLOSING OR SEVERING A TUBE USING A CONTROLLABLE CLOSURE FORCE

This application is a Continuation-in-Part of application Ser. No. 10/919,579, filed on Aug. 17, 2004, now pending, the contents of which are incorporated herein by reference.

FIELD OF THE INVENTION

This invention relates to tube apparatus such as tube sealers. More specifically, this invention relates to a method and apparatus for closing or severing a tube using a controllable force.

BACKGROUND OF THE INVENTION

In a wide variety of applications and industries, there is a need to seal, connect, weld or otherwise manipulate tubes. For example, there is often a need to create a seal at a location along the length of a tube or a portion thereof. Such a seal may be desired to prevent or substantially reduce the flow of gaseous or liquid fluid between adjacent portions of a tube.

One example of an application in which a tube may be desired to be sealed is the sealing of tubes that contain blood or other bodily fluids. For example, blood may be drawn from a donor from flexible tubing that extends into a plastic blood collection bag. Once the bag is filled to its capacity, it may be desired to seal the tubing in order to prevent leakage and/or contamination or deterioration of the collected blood. After such collection, the blood may need to be typed and/or tested under various criteria. In order to provide a representative supply of blood for such typing and test purposes, a plurality of segments of the tubing may be sealed from one another to provide multiple sealed samples. Such samples may later be separately opened for typing and/or testing purposes.

The foregoing comments apply not only to dielectric tube sealers but also to any apparatus configured to connect, weld, or otherwise manipulate tubes using radio frequency, heat, mechanical elements, or any other known means for manipulating tubes.

SUMMARY OF THE INVENTION

According to one aspect, this invention provides a tube apparatus configured to perform a tube operation on a tube portion. An exemplary embodiment of such a tube apparatus may include tube-contacting surfaces spaced from one another to receive the tube portion, at least one of the tube-contacting surfaces being movable with respect to another one of said tube-contacting surfaces to compress the tube portion, means for moving said at least one movable tube-contacting surface, and means for controlling a duty cycle of the moving means according to a compression profile of the moving means.

According to another aspect, this invention provides a tube sealer to control a size of a seal formed in a tube portion. One exemplary embodiment of such a tube sealer may include a plurality of jaws mounted for movement with respect to each other, at least one of the jaws being coupled to an energy source to heat the tube portion, a solenoid coupled to a respective one of the jaws to move the respective one of the jaws to compress the tube portion, and a microprocessor configured to control the energy source and the solenoid, the microprocessor being programmable to select one or more periods during which heating of the tube portion is performed by the energy source and to select one or more compression periods, successive compression periods having a different duty cycle to supply power to the solenoid to adjust a compression action of the solenoid, thereby controlling the size of the seal formed in the tube portion.

According to yet another aspect, this invention includes a method of controlling a tube apparatus configured to seal, weld or sever a tube portion, the tube apparatus including tube-contacting surfaces spaced from one another to receive the tube portion, at least one of said tube-contacting surfaces being movable with respect to another one of said tube-contacting surfaces to compress the tube portion, and an actuator coupled to said at least one movable tube-contacting surface. An exemplary method according to this aspect of the embodiment of the invention may include the steps of controlling a duty cycle of an actuator according to a compression profile of the actuator to compress the tube portion and to control an area of a seal formed in the tube portion and/or a thickness of the sealed tube portion.

According to yet another aspect, this invention includes a method of controlling a tube sealer configured to seal a tube portion, the tube sealer having a heat source to selectively heat the tube portion and an actuator configured to compress the tube portion via at least one movable tube-contacting surface. An exemplary method according to this aspect of the invention may include the steps of selecting one mode of a plurality of selectable modes of operating the tube sealer, each of the modes having heating and compression profiles, the heating and compression profiles defining heating periods of the heat source for heating the tube portion and duty cycles of the actuator for compression of the tube portion, respectively, and during a plurality of periods defined by the selected mode, simultaneously heating and compressing the tube portion according to the heating and compression profiles of the selected mode.

According to yet another aspect, this invention includes a method of controlling a tube sealer configured to seal a tube portion, the tube sealer having a heating source to selectively heat the tube portion and an actuator configured to compress the tube portion, compression by the actuator being controlled according to a duty cycle of the actuator. An exemplary method according to this aspect of the invention may include the steps of simultaneously heating and compressing the tube portion according to a mode selected by a user, each mode including a heating profile and a compression profile, the heating and compressing of the tube portion being adjusted based on a time to produce a measured compression of the tube portion.

According to yet another aspect, this invention includes a computer readable medium to store program code for use in a microprocessor to control a tube sealer having an actuator for compressing a tube portion. An exemplary computer readable medium according to this aspect of an embodiment of the invention may include a program code segment for controlling a duty cycle of the actuator according to a compression profile to compress the tube portion, thereby controlling an area of a seal formed in the tube portion and or a thickness of the sealed tube portion.

BRIEF DESCRIPTION OF THE DRAWING

The invention will described with reference to the exemplary embodiments illustrated in the drawing, of which.

DETAILED DESCRIPTION OF THE INVENTION

Preferred features of exemplary embodiments of this invention will now be described with reference to the figures. It will be appreciated that the spirit and scope of the invention are not limited to the embodiments selected for illustration. Also, it should be noted that the drawings are not rendered to any particular scale or proportion. It is contemplated that any of the configurations and materials described hereafter can be modified within the scope of this invention.

Generally, systems have been proposed to seal tubes using a pair of jaws, such as electrodes, for compressing tubing and applying radio frequency energy to melt the tubing and form a weld to effect a seal. Such systems typically may use a solenoid to compress the tubing as the RF radiation is applied. As the solenoid is activated a coil of the solenoid increases in temperature due to the current applied to the coil. A problem exist in these tube sealing systems that as the solenoid increases in temperature due to the current applied to the coil of the solenoid, compression force of the solenoid significantly decrease because resistance of the coil increases as temperature increases. Thus, frequent use of the tube sealing system, reduces the compression force to compress the tubing which significantly reduces the efficiency of the tube sealing system and produces an increased number of defective seals in the tubing being sealed.

An improved tubing sealing apparatus is provided to reduce or substantially eliminate the compression force reduction in the solenoid when such a system is heavily (i.e., repeatedly) used.

Figure 1:
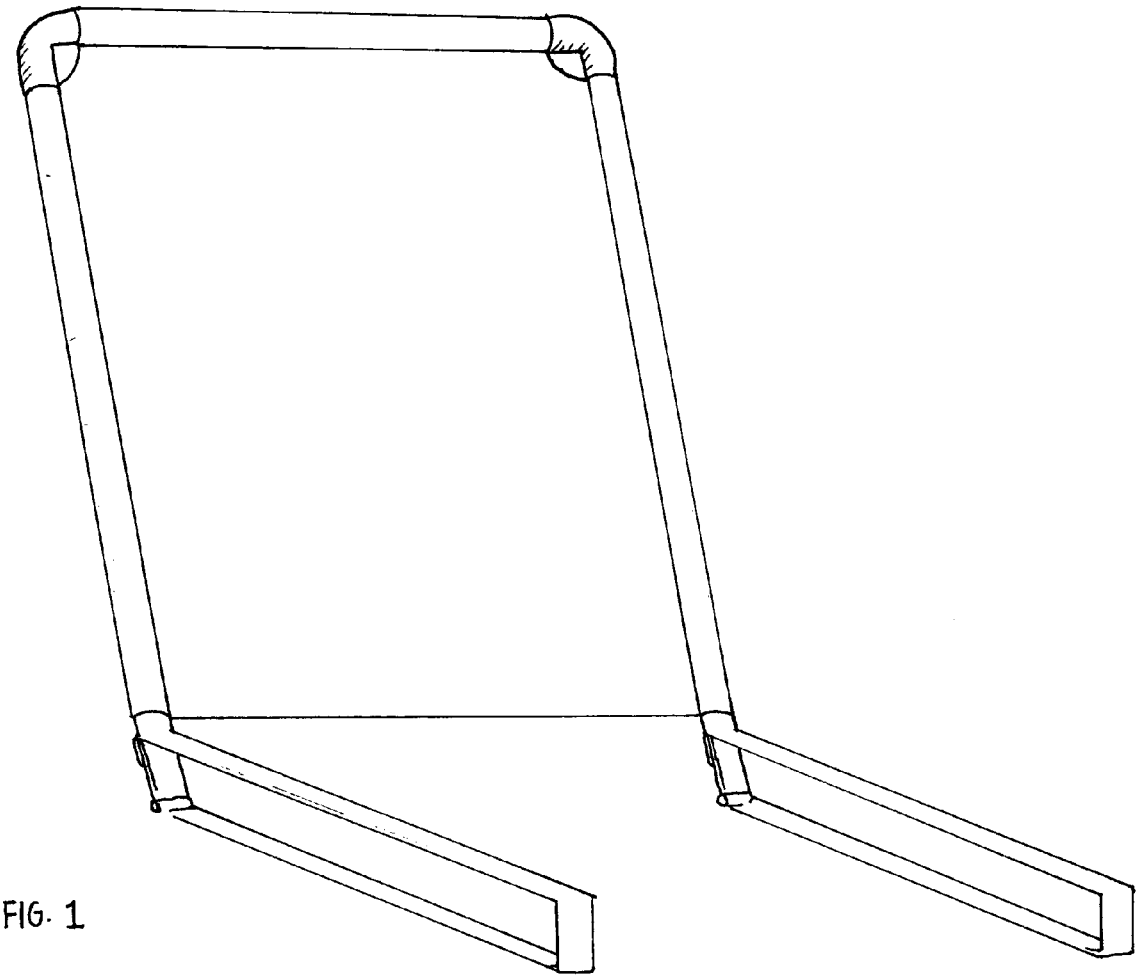
FIGS. 1*a* and 1*b* are front and top views, respectively, of a tube portion sealed according to aspects of this invention.
Figure 2:
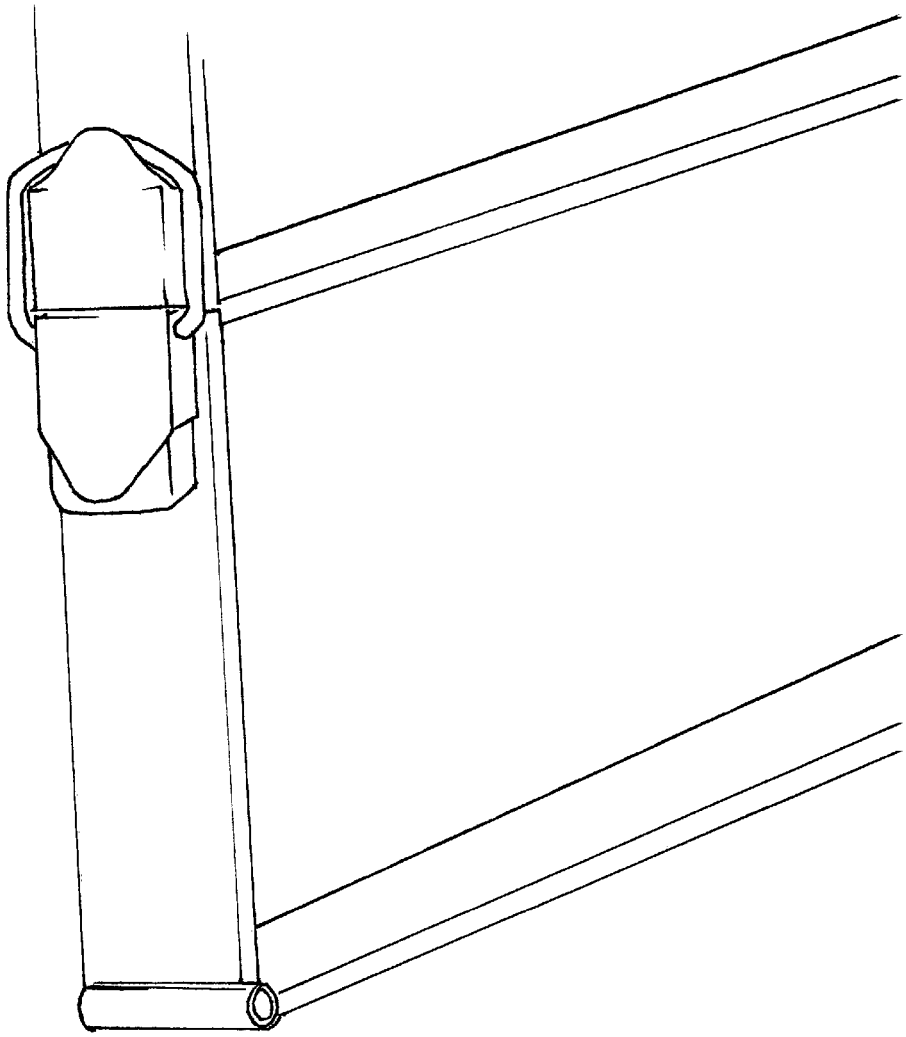
FIG. 2 is a cross-sectional end view of the tube portion illustrated in FIGS. 1*a* and 1*b*.
Figure 3:
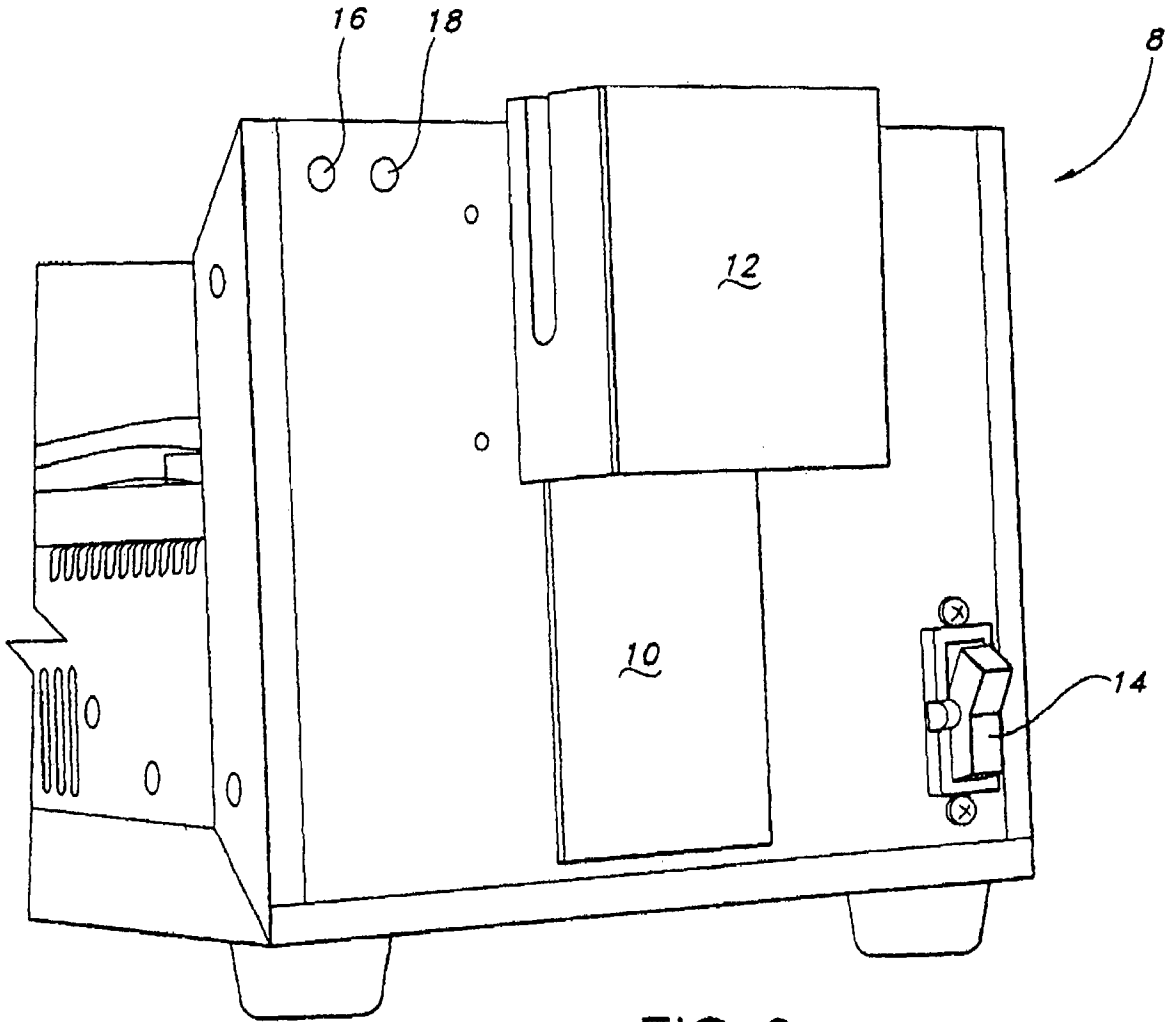
FIG. 3 is a front perspective view of an embodiment of a tube sealer according to aspects of this invention.

Exemplary tube sealers according to aspects of this invention can be adapted to seal tubes such as those illustrated in FIGS. 1*a*, 1*b* and 2. Referring to those figures, a tube portion 2 is illustrated with two (2) seals 4, thereby separating an interior 6 of the tube portion 2 into multiple sections or compartments. As is illustrated in FIGS. 1*a* and 1*b*, the tube portion 2 may have a diameter D and a wall thickness T1. The dimensions of the tube portion 2 can be varied depending upon the nature of the tube and the use thereof.

The tube portion 2 may be a tube used to collect a sample of blood from a donor. If so, the tube portion 2 may be formed from polyvinyl chloride (PVC) or any another suitable material. The seals 4 in the tube portion 2 are formed by compressing the tube so that its walls come into contact with one another and simultaneously subjecting the tube portion 2, in the area of a seal 4, to energy until a seal is formed by heating and softening or melting the tube such that a weld can be formed.

Referring to FIGS. 1*a*, 1*b* and 2, the seals 4 formed in tube portion 2 will have a width W, a height H, and a thickness T2. It has been discovered that it may be desirable to modify, select, and/or control the "size" or "area" defined by one or more of the dimensions W, H, and T2. Generally, there is likely to be some limited flow of the material of the tube in the area of a seal during the formation of the seal. More specifically, the softening or melting of the material of the tube is likely to cause some migration of the material radially outwardly to arrive at a height H of the seal 4 that is greater than diameter D of the tube. Also, the width W of the seal 4 will result from some migration of the material of the tube along the axis of the tube.

The dimensions W, H, and T2 of each seal 4 are impacted by various parameters relating to the energy used to form the seal as well as the jaws of the sealer that directly form the seal. These parameters include the degree of compression imparted on the tube by the jaws (i.e., the minimum gap between the jaws), the duration of the compression (i.e., the time delay before the jaws are separated), and the duration over which the radio frequency energy is generated, among other parameters. It has been discovered that it may be beneficial to permit the adjustment of a tube sealer with respect to one or more of these parameters, as will be discussed later in greater detail.

Referring again to FIGS. 1*a* and 1*b*, a "good" or "successful" weld or seal 4 across a tubing portion 2 will be likely to exist if the combination of melting of the tubing with the compressive force exerted by the jaws forming the seal force lateral flow of the plastic to develop ears or tab portions disposed on opposite sides of the tubing. Such ears or tabs may be indicative of an impermeable seal across the tubing.

Generally referring to FIGS. 3-7, one aspect of this invention provides a dielectric tube sealer 8 adapted to limit radio frequency emissions or emanations during operation. The dielectric tube sealer 8 includes an enclosure such as a cabinet 10 and first and second jaws (i.e. first and second tube-contacting surfaces) 42 and 26, respectively, oriented with respect to the cabinet 10 to receive a tube portion in a space therebetween. The first jaw 42 is fixed and is coupled to a radio frequency generator, and the second jaw 26 is movable with respect to the first jaw 42 and is coupled to ground potential. A shield 12 is positioned adjacent the cabinet 10 and configured to at least partially enclose the first and second jaws 42 and 26 yet permit the introduction of a tube portion to a position between the first and second jaws 42 and 26. The shield 12 thereby reduces radio frequency emanations from the first jaw 42, and the shield 12 can be movable with respect to the cabinet 10 to at least partially expose the first and second jaws 42 and 26.

According to another aspect of the invention, a dielectric tube sealer 8 is adapted to detect successful or failed seals. The dielectric tube sealer 8 includes jaws 26 and 42 mounted for movement with respect to one another between (1) a first position spaced from one another to receive a tube portion and (2) a second position proximal one another to compress the tube portion, wherein the jaws 26 and 42 in the second position define a gap selected to form a successful seal. The dielectric tube sealer 8 also includes a sensor 204 positioned to detect when the jaws 26 and 42 have moved into the second position. The dielectric tube sealer 8 also includes a timer electrically coupled to the sensor 204 for determining the time delay before the jaws 26 and 42 have moved into the second position. A time delay up to a predetermined time limit indicates a successful seal, and a time delay exceeding the predetermined limit indicates a failed seal.

According to another aspect of the invention, a dielectric tube sealer 8 includes a radio frequency generator configured to generate radio frequency for a time period. Jaws 26 and 42 are mounted for movement with respect to one another, one of the jaws 26 or 42 being coupled to the radio frequency generator. The dielectric tube sealer 8 also includes a microprocessor or microcontroller 206 configured to control the radio frequency generator. The microcontroller 206 is programmable to select the time period or time periods during which radio frequency is generated by the radio frequency generator, thereby controlling the area of the seal formed in a tube.

Referring to FIGS. 3-7, exemplary features of one embodiment of a tube sealer according to this invention will now be described. The dielectric tube sealer 8 includes a cabinet 10 to which a cover or shield 12 is removably mounted. The dielectric tube sealer 8 also includes a power switch 14 which acts as an on/off switch for the operation of the unit. The dielectric tube sealer 8 further includes a power indicator 16 and a seal indicator 18, both of which may take the form of an LED according to one exemplary embodiment of the invention. The seal indicator 18 will be on when the solenoid is energized. When the shield 12 is off and the unit is inoperable, the seal indicator 18 will flash (except when the unit is in programming mode as will be described later).

Figure 4:
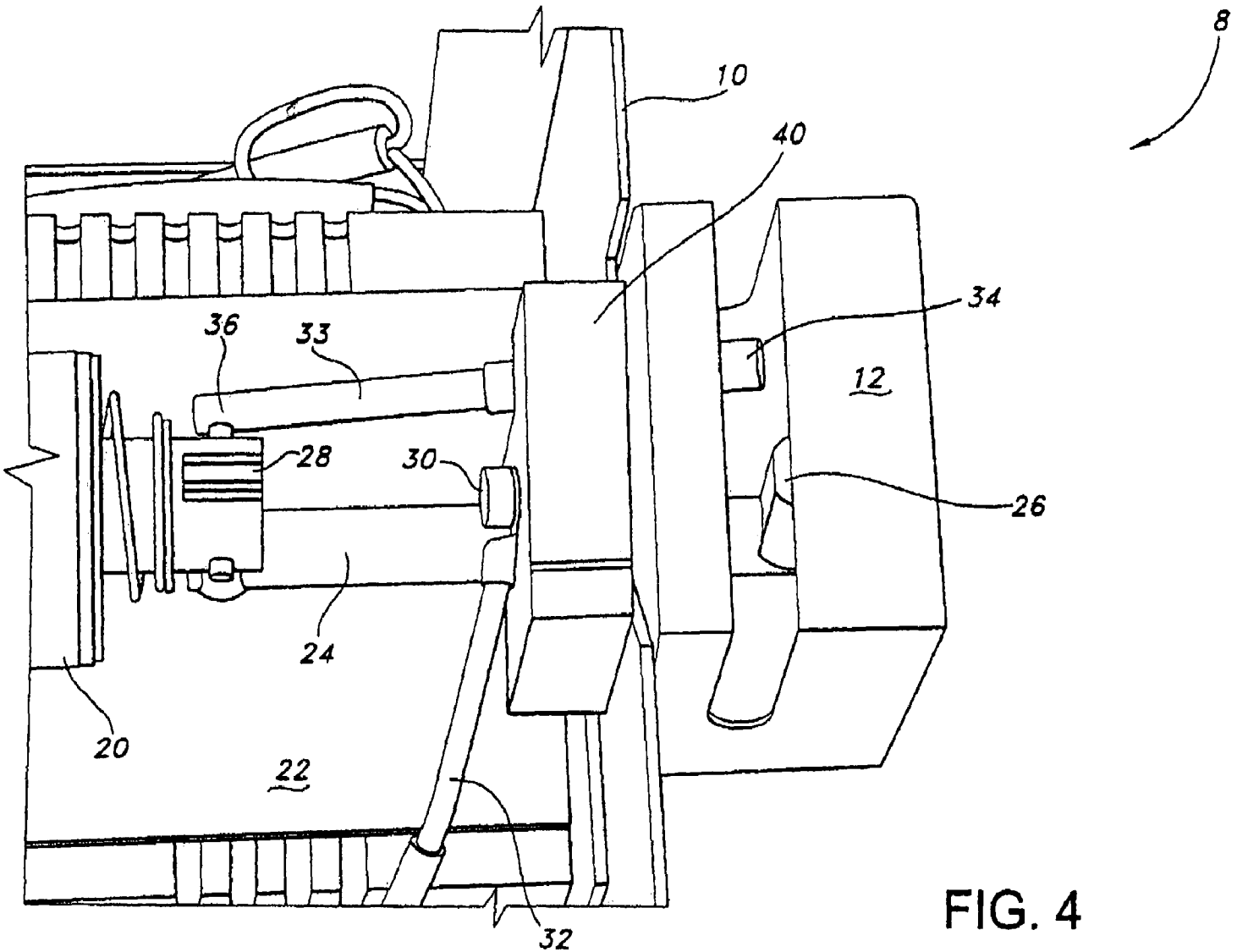
FIG. 4 is a top perspective view of the tube sealer shown in FIG. 3.

Referring specifically to FIG. 4, which reveals internal features of the dielectric tube sealer 8, an actuator (e.g., solenoid 20) is mounted on a mounting platform 22 within an interior of the cabinet 10. It will be noted that, although cabinet 10 is adapted as a table-top unit, cabinet 10 may also be reconfigured as a hand-held device that is remote from other components that are illustrated within the cabinet 10 in FIGS. 3-7. Coupled to the solenoid 20 is a ground jaw shaft 24 on which the ground jaw 26 is positioned. A flag 28 is provided as a part of the assembly of the ground jaw shaft 24 in order to actuate a stop sensor 204, which will be described in further detail later.

Figure 5:
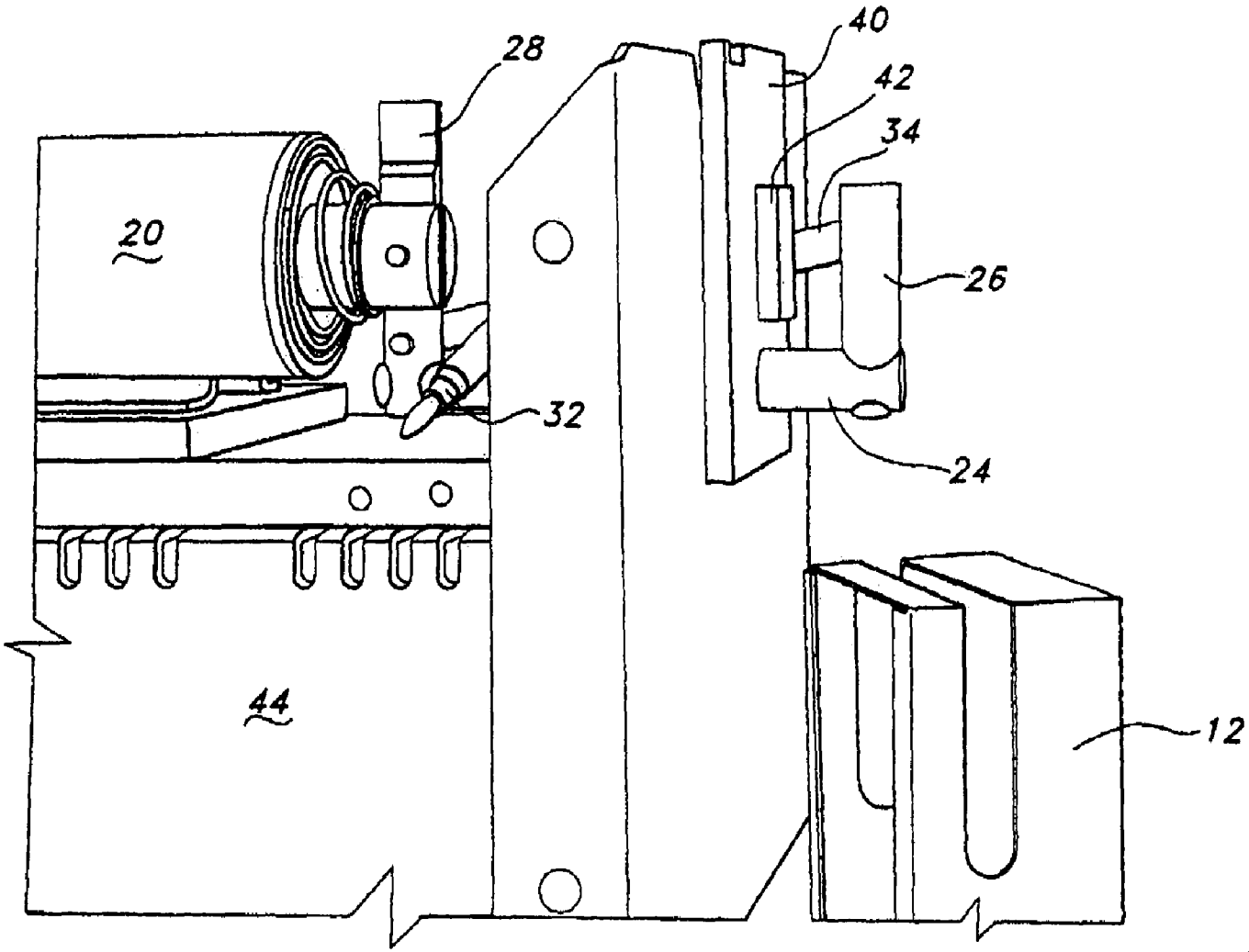
FIG. 5 is a side perspective view of the tube sealer shown in FIG. 3.

A fastener 30, which may take the form of a cap-head screw or any other suitable fastener, is used to make a connection between a wire 32 leading to a radio frequency board (FIG. 10) and the RF jaw 42 (see RF jaw 42 in FIG. 5, for example). A start lever 33 is also provided as a component of the dielectric tube sealer 8. The start lever 33 has a proximal end 34 and a distal end 36, wherein the proximal end 34 extends outwardly from the cabinet 10 and the distal end 36 extends inwardly into the interior of cabinet 10. The proximal end 34 of the start lever 33 is depressed downwardly when a tube is introduced into a position between the ground jaw 26 and the RF jaw 42, and the distal end 36 of the start lever 33 is pivoted upwardly. A flag (not shown) toward the distal end 36 of start lever 33 actuates a start sensor 205 (FIG. 11), details of which will be provided later.

The start lever 33, ground jaw shaft 24, and connection to the RF jaw 42 each passes through an insulator 40. According to exemplary aspects of the invention, the insulator 40 is in the form of a block of insulating material. The insulating material may be DELRIN, for example, or any other suitable insulator. If DELRIN is used, it is preferably black to provide a UV protectant. The insulator 40 serves two (2) purposes according to exemplary features of this invention; namely, it isolates the radio frequency potential applied to the RF jaw from the ground potential of the ground jaw and it provides a low-friction surface through which moving parts (e.g., ground jaw shaft 24) can slide.

Referring to FIG. 5, it will be seen that a portion of the RF jaw 42 extends outwardly beyond the surface of the insulator 40, thereby exposing a surface of the RF jaw 42 for contact with a tube portion to be sealed. Also shown in FIG. 5 is a power supply 44, which is positioned under the mounting platform 22. Although not shown in FIG. 5, it has been discovered that there is benefit in selecting a power supply 44 that incorporates a fan for heat dissipation. Heat will of course be generated within the cabinet 10 by virtue of the operation of the solenoid 20 and other components of the system. It has been discovered that the positioning of a power supply 44 toward the base of the cabinet 10 can help dissipate significant heat when the power supply 44 is provided with the fan. More specifically, the fan of the power supply 44 exhausts heat downwardly and outwardly through a base portion of the cabinet 10.

Referring still to FIG. 5, the RF jaw remains fixed with respect to the cabinet 10 and the ground jaw 26 moves with respect to the RF jaw 42 by virtue of sliding movement of ground jaw shaft 24 through an aperture in the insulator 40 and the action of the solenoid 20. More specifically, upon actuation of the dielectric tube sealer 8 to seal a portion of a tube, the solenoid 20 will withdraw the ground jaw shaft 24 toward the interior of the cabinet 10, thereby moving the ground jaw 26 closer the RF jaw 42. In that manner, the jaws 26 and 42 have two (2) positions; namely, an open position in which the jaws 26 and 42 are separated from one another a distance sufficient to receive a tube, and a closed position in which the jaws 26 and 42 are proximal to one another such that a tube positioned therebetween will be in a compressed state. The gap between the jaws 26 and 42 when the jaws are in the closed position is selected to correspond substantially to the desired thickness T2 of the seal 4 (see FIG. 2).

That gap can be periodically adjusted during calibration of the dielectric tube sealer 8 to ensure that an appropriate thickness T2 is imparted to a seal. Also, the gap can be adjusted to avoid arcing between the jaws, which would otherwise occur if the jaws were too close together. On the other hand, if the jaws are too far apart, the seal of the tube might not be properly formed and might leak.

When the jaws 26 and 42 are in the closed position (not shown), the flag 28 on the opposite end of the ground jaw shaft 24 will block an optical sensor such as stop sensor 204 to signal that the seal is virtually complete. Accordingly, the flag 28 is sized and positioned to actuate such a sensor as the jaws 26 and 42 enter the closed position. For example, when the gap between jaws 26 and 42 is reduced to a predetermined size (e.g., 0.1 mm-0.2 mm), the flag 28 will trigger the sensor to indicate full compression of the tubing.

Figure 12:
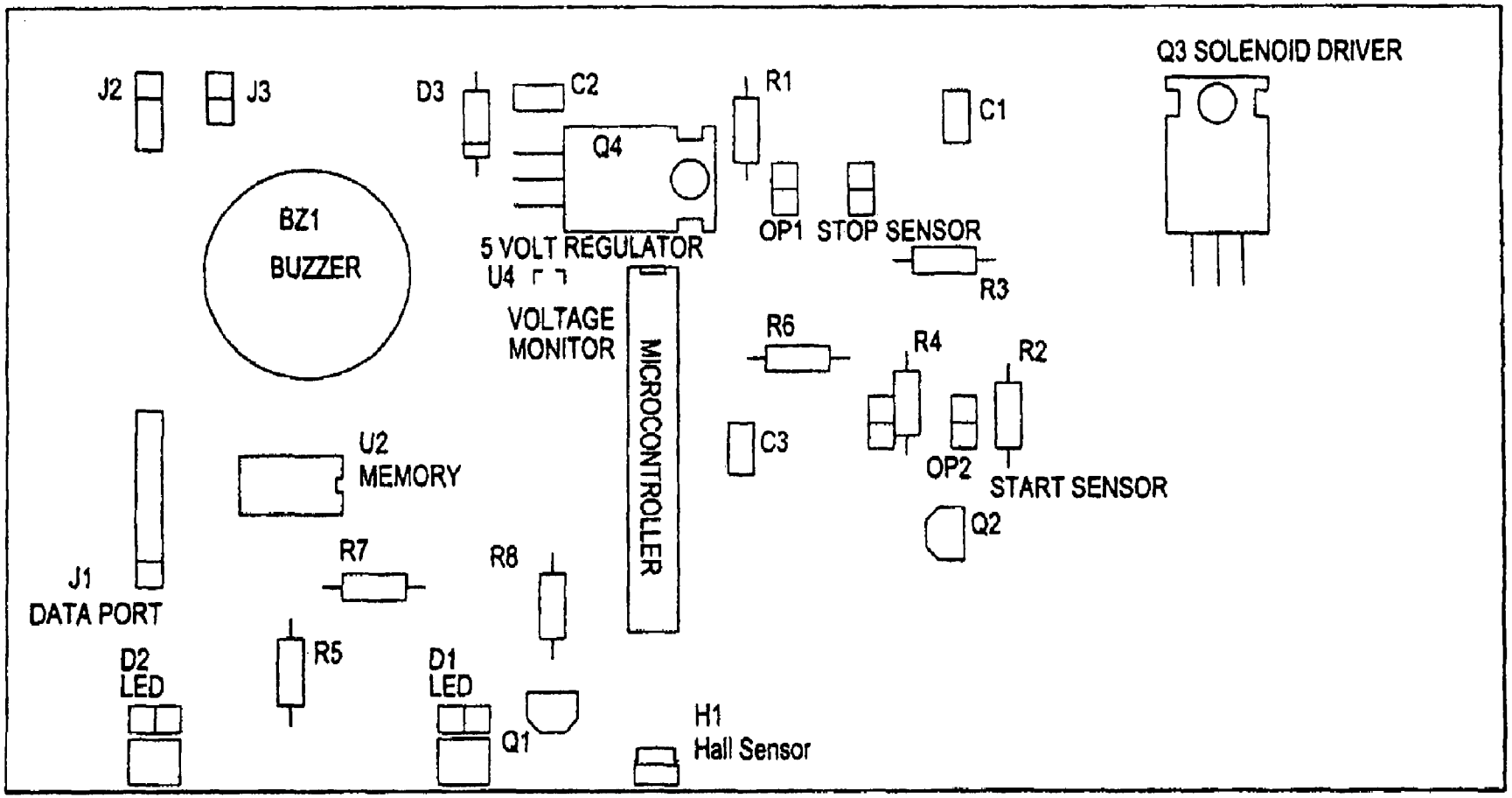
FIG. 12 illustrates an embodiment of a control board according to aspects of this invention.

Although not shown in FIGS. 3-7, a controller board, such as the exemplary embodiment of a board shown in FIG. 12, is mounted in a horizontal position extending rearwardly from the top of the insulator block 40. Standard fasteners can be used to fasten the board to the insulator block 40 or to otherwise mount the board within the cabinet 10. The sensors for sensing the flags on the start lever 33 and the ground jaw shaft 24 are mounted to the controller board and are positioned on the board in locations selected to correspond to the respective flags on the start lever 33 and ground jaw shaft 24.

Figure 6:
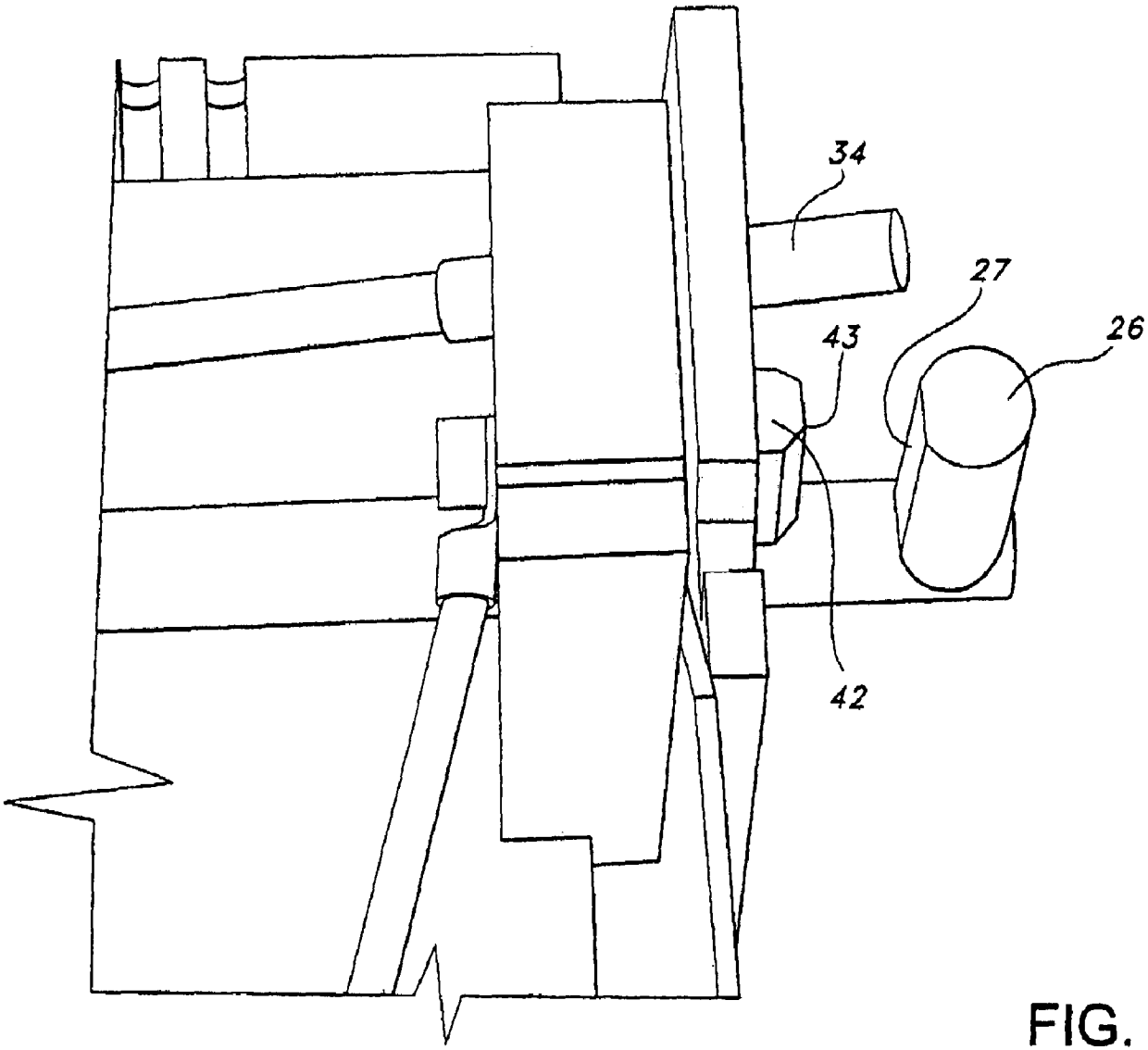
FIG. 6 is another top perspective view of the tube sealer shown in FIG. 3.

Referring now to FIG. 6, it will be seen that the RF jaw 42 is provided with a substantially flat surface 43 for contact with a tube portion to be sealed. Similarly, the ground jaw 26 is also provided with a substantially flat surface 27 for contact with the opposite side of the tube portion. These flat surfaces 27 and 43 are sized and oriented so as to impart a predetermined configuration to a seal 4 in a tube portion 2. It will be appreciated that the widths and other dimensions of the flat surfaces 27 and 43 can be modified so as to alter the configuration of the seal 4. More specifically, the surfaces 27 and 43 can be modified to impart functional or ornamental features to the surface of the seal, depending upon the particular application or preferences of the end user. Also, the texture or finish of the surfaces 43 and 27 can be modified to impart a particular surface feature to the seal.

As shown in the figures, the ground jaw shaft 24 is substantially rounded in cross-sectional shape. For example, a cylindrical shape for ground jaw shaft 24 can be selected to correspond to a through-hole formed in the insulator 40. Also, a cylindrical shaft or otherwise rounded shaft may be easier to clean in the instance of leaked fluids because the cylindrical shape will not encourage an accumulation of fluids on the ground jaw shaft 24. The portion of ground jaw shaft 24 on which the ground jaw 26 is formed is also substantially cylindrical except for the flat surface 27 formed thereon.

As is best illustrated in FIG. 5, it will be seen that the axis of the longitudinally extending portion of the ground jaw shaft 24 is spaced from, but substantially parallel to, the axis of the solenoid 20. Also, the axis of the solenoid 20 corresponds to the position on the RF jaw 42 and ground jaw 26 that contact a tube portion to be sealed. In order to provide this feature, the ground jaw shaft 24 (extending all the way from the flag 28 extending upwardly beyond the axis of the solenoid to the top of the ground jaw 26) forms a substantially "U" shaped configuration. Such a configuration makes it possible to compress a tube portion along an axis of compression that is common to the axis of the solenoid 20.

The ground and RF jaws are, according to one exemplary embodiment, formed from a metal but can optionally be formed from any conductive material. The jaws can be formed from steel plate or rod by known forming techniques.

It has been discovered that the configuration of the RF jaw as a fixed jaw at least partially insulated and located adjacent the cabinet 10 helps to reduce the radio frequency emanations from the dielectric tube sealer 8. More specifically, the mounting of the RF jaw at least partially within an insulator block such as insulator 40 helps to shield the emanations of radio frequency energy. This can be accomplished by configuring the ground jaw 26 to be the moving jaw that extends outwardly from the cabinet 10. By exposing the ground jaw 26 as the outer jaw, as opposed to the RF jaw 42, the radio frequency emanations from the dielectric tube sealer 8 are further reduced. The configuration of the ground jaw shaft 42 as an exemplary "U" shaped configuration permits the orientation of the stationery RF jaw 42 in or near the cabinet with the ground jaw 26 extending outwardly beyond the RF jaw 42.

Figure 7:
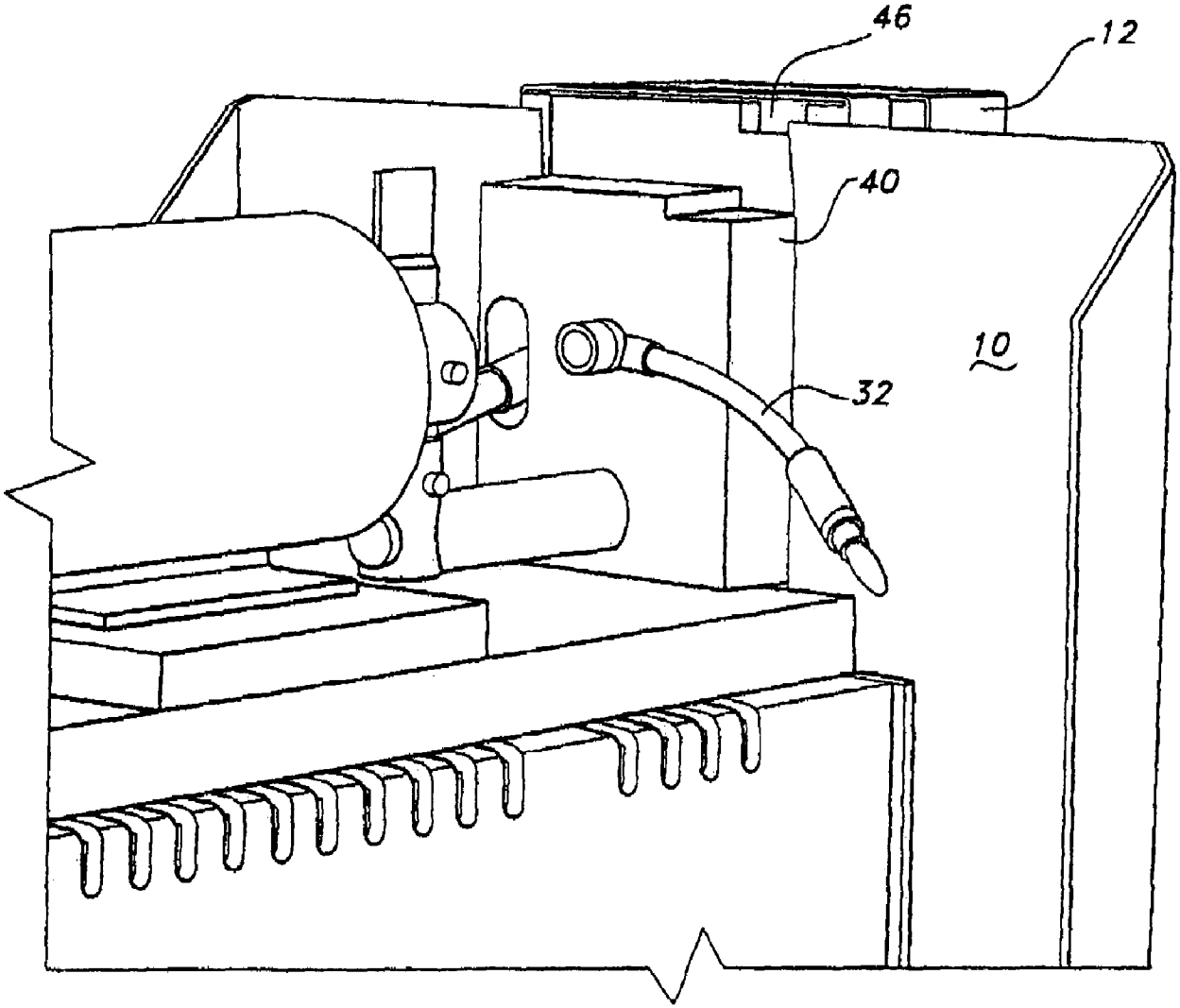
FIG. 7 is a rear perspective view of an interior region of the tube sealer shown in FIG. 3.

Referring now to FIG. 7, a magnet 46 is mounted to a portion of the shield 12. Although not shown in FIG. 7, HALL effect sensor "H1" on the control board shown on FIG. 12 corresponds in position to the magnet 46 when the shield 12 is in place and the control board is mounted within the cabinet 10. By virtue of the HALL effect sensor, therefore, the presence or absence of the magnet 46 (and therefore the presence or absence of the cover or shield 12) can be detected.

It has been discovered that combined features of the exemplary dielectric tube sealer 8 cooperate to reduce emanations of radio frequency energy during operation of the sealer.

Although each of the foregoing features helps to reduce radio frequency emanations, the combination of the shield 12, the at least partial insulation of the stationery RF jaw 42, and the outward positioning of the movable ground jaw 26 provide significant reductions in RF emanations.

Also, the configuration of the jaws and the insulator with respect to one another helps to prevent arcing between the jaws (e.g., arcing between ground and RF potentials). More specifically, the extension of jaw 42 outwardly from the insulator 40 helps to prevent bridging of fluids such as blood between the RF jaw 42 and the ground jaw shaft 24.

In the exemplary embodiment illustrated in the figures, the shield 12 is removably mounted adjacent the cabinet 10. Removal of the shield 12 facilitates cleaning and maintenance of the jaws and other components of the tube sealer 8. As will be described later in greater detail, the removal of the shield 12 also facilitates the periodic calibration of the tube sealer to maintain an appropriate seal thickness and facilitates the programming of the tube sealer.

While the exemplary shield 12 is removable and replaceable by virtue of a sliding engagement with the insulating block 40, the tube sealer is configured to prevent its operation while the shield 12 is not in place. Contact between the shield 12 and the cabinet (e.g., by virtue of the flanges of the shield 12 extending between the insulator 40 and the cabinet 10) is optionally provided to ground the shield 12.

The shield 12 may be formed from a conductive material such as a metal. The slot (not numbered) in the shield 12 permits a user to insert a portion of the tube to be sealed between the jaws of the dielectric tube sealer 8. The shape and configuration of the slot and the body of the shield are not important, however.

Figure 8A:
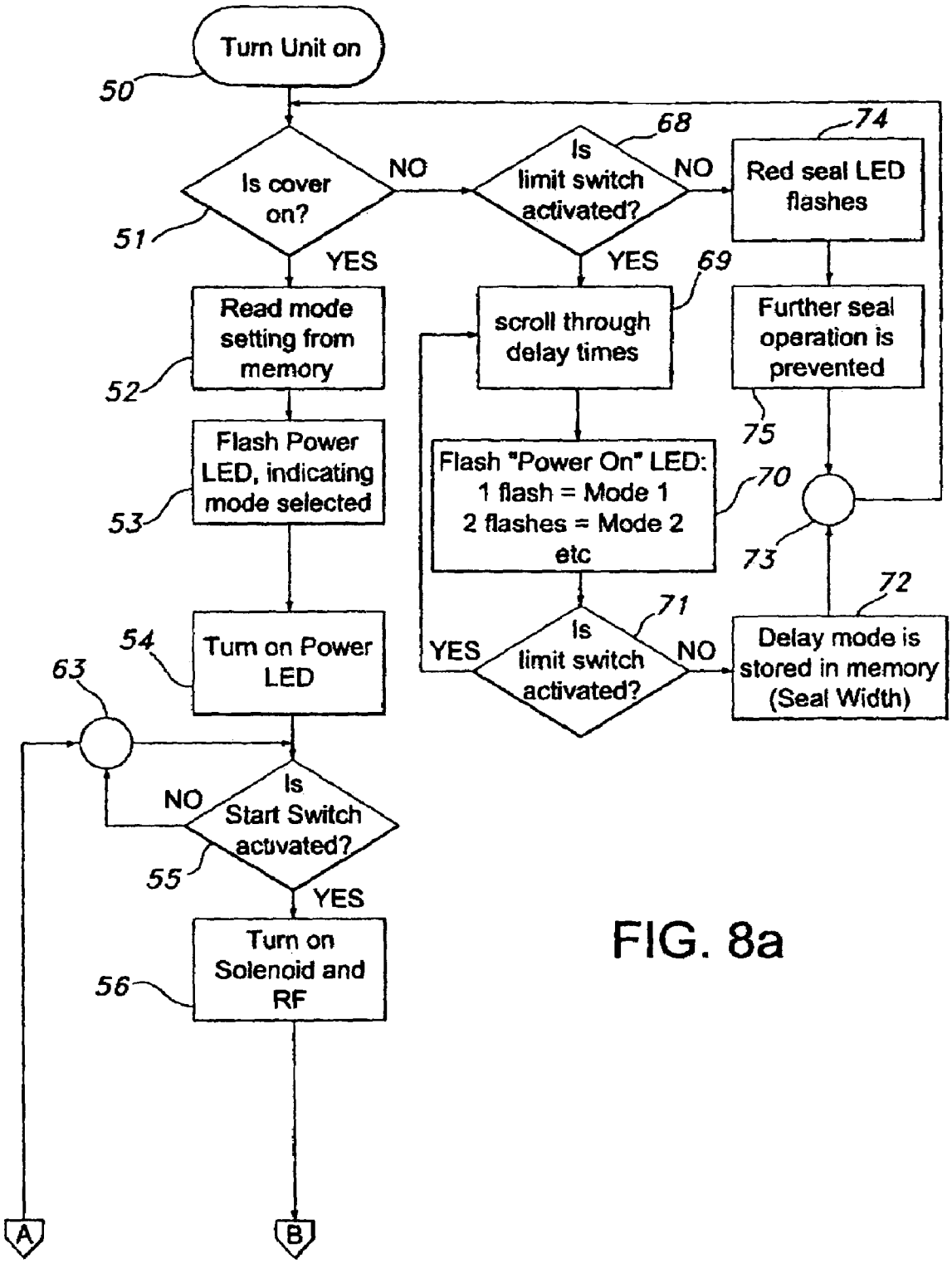
FIGS. 8*a* and 8*b* provide a flow diagram illustrating the use of an embodiment of a tube sealer according to aspects of this invention.
Figure 8B:
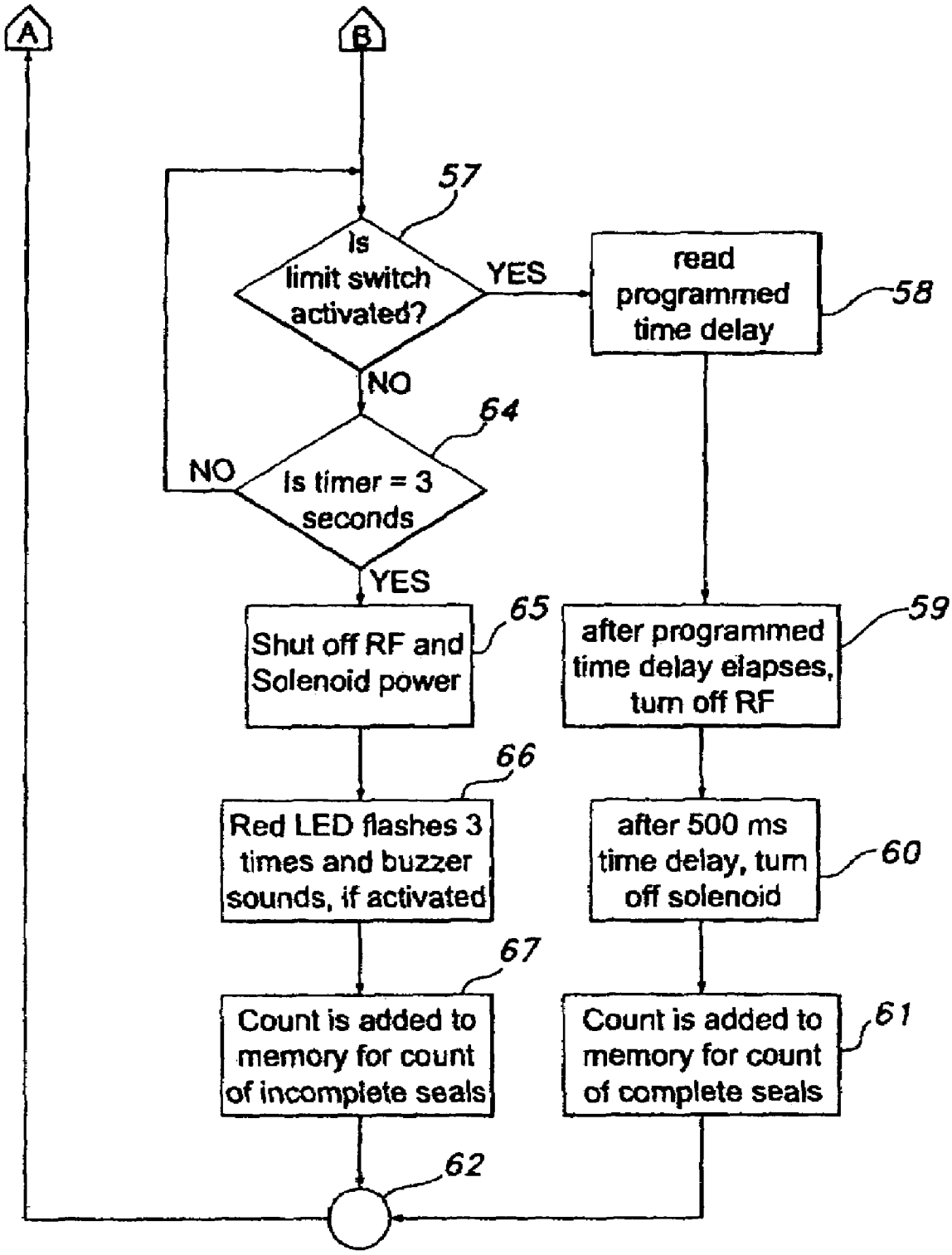

Referring now to FIGS. 8*a* and 8*b*, a flow diagram illustrating operation of an exemplary embodiment of a tube sealer according to this invention will now be described. Steps 50-63 roughly correspond to an exemplary sealing operation of the unit, steps 64-67 illustrate exemplary operation of the system in connection with a failed seal, steps 68-73 illustrate an exemplary programming mode, and steps 74 and 75 illustrate an exemplary inoperable mode.

Referring first to the exemplary sealing operation illustrated in steps 50-63 in FIGS. 8*a* and 8*b*, the unit is turned on in step 50, which is followed by a query in step 51 as to whether the cover or shield 12 is in place. This query can be answered, for example, by use of a Hall sensor to detect the presence or absence of a magnet 46 on the shield 12. In step 52, the mode setting is read from the memory of the sealing unit, and the power LED is flashed in step 53 to indicate the mode selected. The number of flashed of the LED can indicate the mode. The mode may correspond, for example, to the time delay mode selected in steps 68-73 (described later). After the mode selected is indicated, the power LED is turned on in step 54.

In step 55, a query asks whether the start switch has been activated. This query can be answered, for example, with the use of an optical sensor such as the start sensor 205 to detect the presence or absence of a flag on a distal end 36 of the start lever 33, which would indicate that a tube portion has been inserted between the jaws of the sealer, thereby depressing the proximal end 34 of the start lever 33. If the start switch has been activated, the solenoid and RF generator (and red seal LED) are turned on in step 56. Step 57 queries whether the limit switch is activated, which can be answered, for example, depending on whether the flag 28 on the ground jaw shaft 24 is sensed by the optical sensor or stop sensor 204 on the control board. If so, the programmed time delay is read in step 58 and the RF generator is turned off after the programmed time delay elapses in step 59. After a predetermined time (e.g., 500 ms), which may be selected based on the amount of time desired for the seal to cool adequately, the solenoid (and red seal LED) is turned off in step 60, and a count is added to the memory for an updated count of complete seals in step 61. The successful seal is then completed in step 62 and the unit can then be readied to create another seal at step 63. If at any time during power "on" of the sealer the sealer cover 12 is removed, then the seal LED remains flashing and the unit will not respond to the start sensor 205.

Referring now to the exemplary failed seal mode in steps 64-67, a query is made in step 64 to determine whether 3 seconds, or some other predetermined delay, has elapsed since the solenoid and RF generator were turned on in step 56. If so, that means that too much time has elapsed since the start of the sealing process without a full seal being indicated by the limit switch. In other words, thereby indicating that the seal has not yet been made. If so, the RF generator and solenoid power are shut off in step 65, and the seal LED flashes 3 times to indicate to the user of the sealer that the seal was unsuccessful in step 66. If a buzzer is incorporated into the sealer system as an audible indicator to the user and the buzzer is programmed to activate, then the buzzer is sounded in step 66. In step 67, a count is added to the memory to updated the count of incomplete seals and the sealer is readied for another attempt at steps 62 and 63.

Referring now to the exemplary programming mode in steps 68-73, if the cover is off (step 51) and the limit switch or stop sensor 204 is activated (step 68) during system start up, then the sealer unit scrolls through a menu of available delay times in step 69. Accordingly, the programming mode in steps 68-73 is initiated by: (1) either removing the cover 12, using start lever 33 to activate the limit switch or, otherwise, pushing the ground jaw 26 in to activate the limit switch, (2) turning the unit on, and (3) selecting a delay time. In step 70, the power LED can flash as an indicator of a variety of selectable delay times and/or an audible alarm mode. In one embodiment, six (6) modes are available for selection.

Program mode is initiated when the shield 12 is off, the limit switch is activated, and the power is then turned on. If the cover or shield is removed after power up and the limit switch is triggered, the unit will not enter program mode.

For example, one flash may correspond to a particular mode with a delay time. As mentioned, the user of the system can activate the limit switch (step 68) by either using start lever 33 or, otherwise, pushing in the ground jaw shaft 24 or ground jaw 26 while the cover is off. While in the programming mode, the system will continue to scroll through the menu of possible delay times until the limit is switch is deactivated at step 71. In other words, if the limit switch remains activated (e.g., by the user retaining the ground jaw shaft 24 in a closed position) then the system will continue to scroll delay times. Upon release of the ground jaw shaft 24 by the user, the limit switch will thereby be deactivated in step 71 and the delay mode selected by the user by deactivating the limit switch is then stored in the memory in step 72.

The various programmed modes may determine the delay times and/or the nature of the indicator with respect to failed and successful seals. For example, a menu of program modes can include modes configured to sound an audible alarm (e.g., a buzzer) in the event of a failed seal. Alternatively, modes can dictate a silent, visual alarm depending on the preferences of the end user.

In one exemplary embodiment, six (6) modes are provided to offer three delay times with an audible indicator and three delay times without the audible indicator. The delay times can be, for example, 50 ms, 100 ms, and 150 ms, but a variety of delay times can be provided depending on the material to be sealed, the size of the tubing, the application for the tube sealer, and other factors.

As indicated in step 72, the delay mode selected by the user will correlate to a desired seal width. Generally, the longer the delay time (i.e., prior to turning off the RF generator), then the wider the seal may be. After step 72, the programming mode is concluded at step 73.

Referring now to an exemplary inoperable mode of the dielectric tube sealer 8 in steps 74 and 75, if the cover is off (step 51) and the limit switch is not activated (step 68), then the unit should not be operated by a user and a warning is delivered to the user in the form of the flashing of the seal LED in step 74. As indicated in step 75, further seal operation is prevented, and the system is returned to the query of whether or not the cover is on (step 51).

Figure 9:
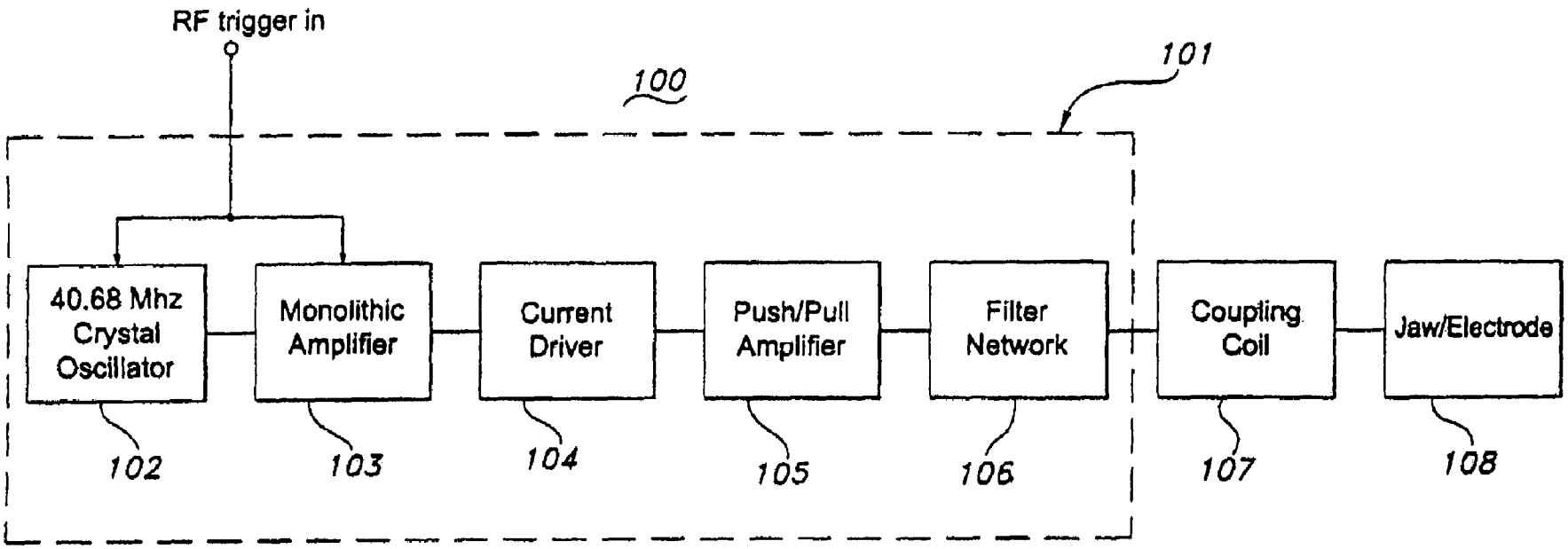
FIG. 9 provides block diagram of a radio frequency amplifier according to aspects of this invention.

Referring next to FIG. 9, there is shown an exemplary block diagram of a radio frequency (RF) energy generator, generally designated as 100, for providing RF power to melt and weld a seal across a plastic tube. As shown, RF energy generator 100 includes RF amplifier 101, coupling coil 107 and jaw/electrode 108. RF amplifier 101 may include crystal oscillator 102, monolithic amplifier 103, current driver 104, push/pull amplifier 105, and filter network 106. These are discussed below.

Figure 10:
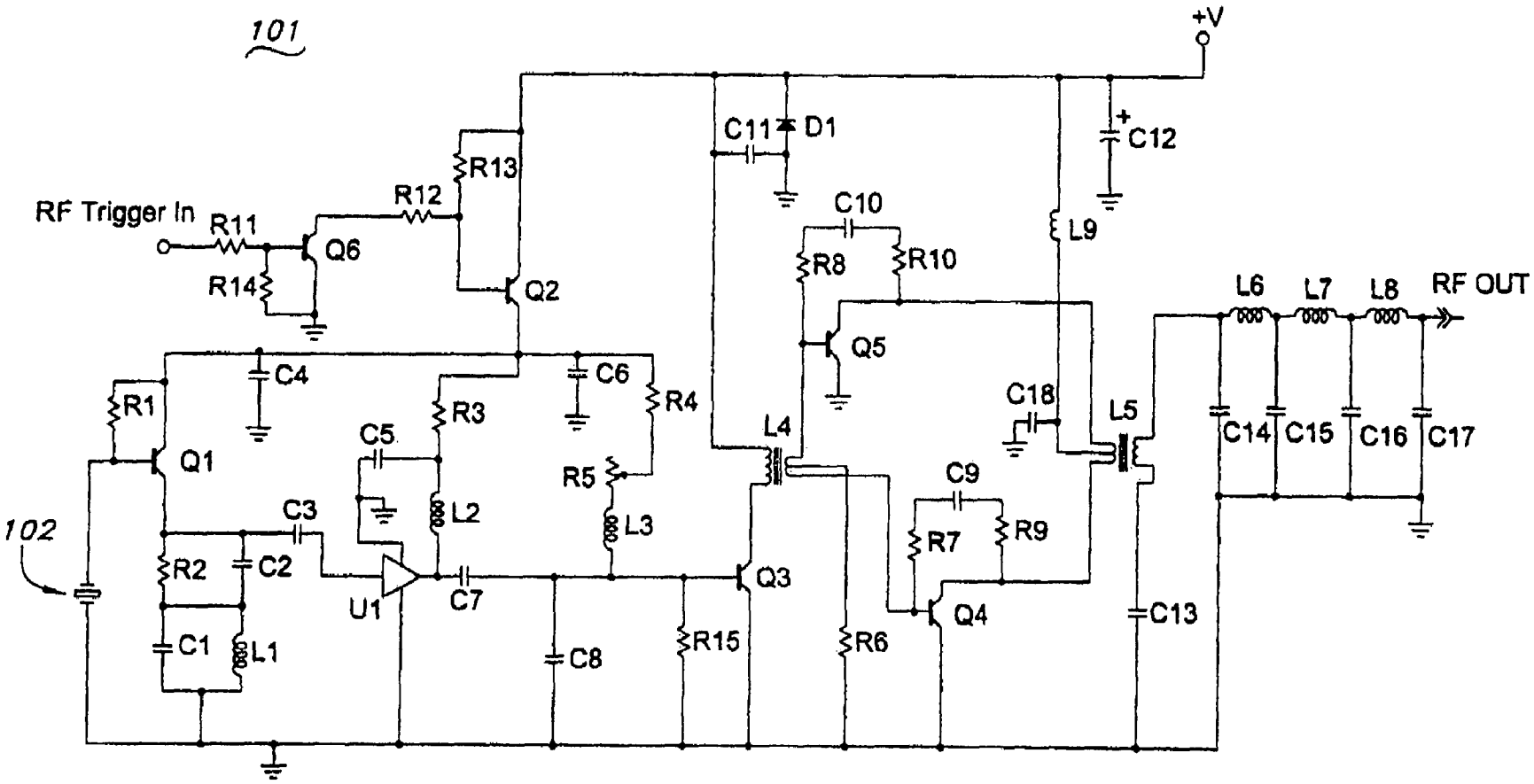
FIG. 10 illustrates a circuit diagram for an embodiment of an exemplary radio frequency generator according to aspects of this invention.

An exemplary electrical circuit of RF amplifier 101 is shown in FIG. 10, and may include electrical components that are surface mountable on a single board. Referring to both FIGS. 9 and 10, there is shown crystal oscillator 102 capable of providing an RF signal at 40.68 MHz. The RF signal provided by crystal oscillator 102 may be filtered by a network of components (R2, C1, C2, C3 and L1) prior to amplification by monolithic amplifier 103. The monolithic amplifier, designated as U1 in FIG. 10, may be a MAV11 monolithic amplifier for providing an amplified RF output that may be adjustable by way of resistive components R4, R5 and R15. The RF energy is adjustable largely by potentiometer R5. Alternatively, resistive components R4 and R5 can be removed, allowing the amplifier to run at maximum power, which will be controlled by fixed resistor R3.

The crystal oscillator and monolithic amplifier may be turned on/off by way of switching transistors Q6 and Q2. Upon activation by RF trigger input signal (provided from a control circuit, discussed below), transistors Q6 and Q2 may be turned on, thereby allowing voltage, +V, to saturate transistor Q1 and start RF oscillation. Switching transistors Q6 and Q2 will activate monolithic amplifier U1 to amplify the RF oscillation.

The output energy from monolithic amplifier 103 may be filtered by various components including C5, C7, C8, L2 and L3. The filtering advantageously prevents RF energy from feeding into the power supply and noise from reaching a microcontroller residing on the control circuit (discussed below). The output energy from monolithic amplifier 103 is further amplified by current driver 104 and push/pull amplifier 105. Current driver 104 may include power amplifier Q3 for driving step-down transformer L4 (5T to 1T), which effectively lowers the output voltage and increases the current by a five-to-one ratio. The output of step-down transformer L4 may be provided to push/pull amplifier 105. In the exemplary embodiment of FIG. 10, the push/pull amplifier may have a configuration that includes transistors Q4 and Q5 for driving step-up transformer L5 (1T to 3T).

The amplified RF output signal from push/pull amplifier 105 may be low pass filtered by filter network 106 and may include components L6, L7, L8, C13, C14, C15, C16 and C17. It will be appreciated that filter network 106 may provide a cut-off frequency for RF harmonics above the baseband frequency of crystal oscillator 102.

Completing description of RF amplifier 101, additional filtering components may be included on the surface mountable RF board, such as D1, L9, C11, C12 and C18. These additional filtering components may further prevent RF noise from reaching the power supply (+V, for example) and the microcontroller on the control circuit.

In the embodiment shown, the amplified RF output signal is sent to coupling coil 107, which may be mounted separately from RF amplifier 101. Coupling coil 107 may be included to provide a matching impedance (50 ohms) between filter network 106 and jaw electrode 108. In this manner, sufficient RF energy may be radiated from jaw electrode 108 to provide efficient melting and welding of the plastic tubing.

In the RF circuit of FIG. 10, monolithic amplifier U1, may be configured to provide approximately 8-9 dB of amplification. Coupled between oscillator 102 and current amplifier Q3, the monolithic amplifier amplifies the low output signal from oscillator 102 and may achieve a maximum output power of 0.5 watts, for example. Sufficient gain is provided from the monolithic amplifier to directly drive current amplifier Q3.

It will be appreciated that the monolithic amplifier is optionally utilized to provide gain in a single stage that conventionally may require three or more stages of amplification. The monolithic amplifier also requires less filtering. As a result, the RF circuit may be compact and small in size. The monolithic amplifier may, for example, be an MAV-11 amplifier manufactured by Mini-Circuits in Brooklyn, N.Y.

Figure 11:
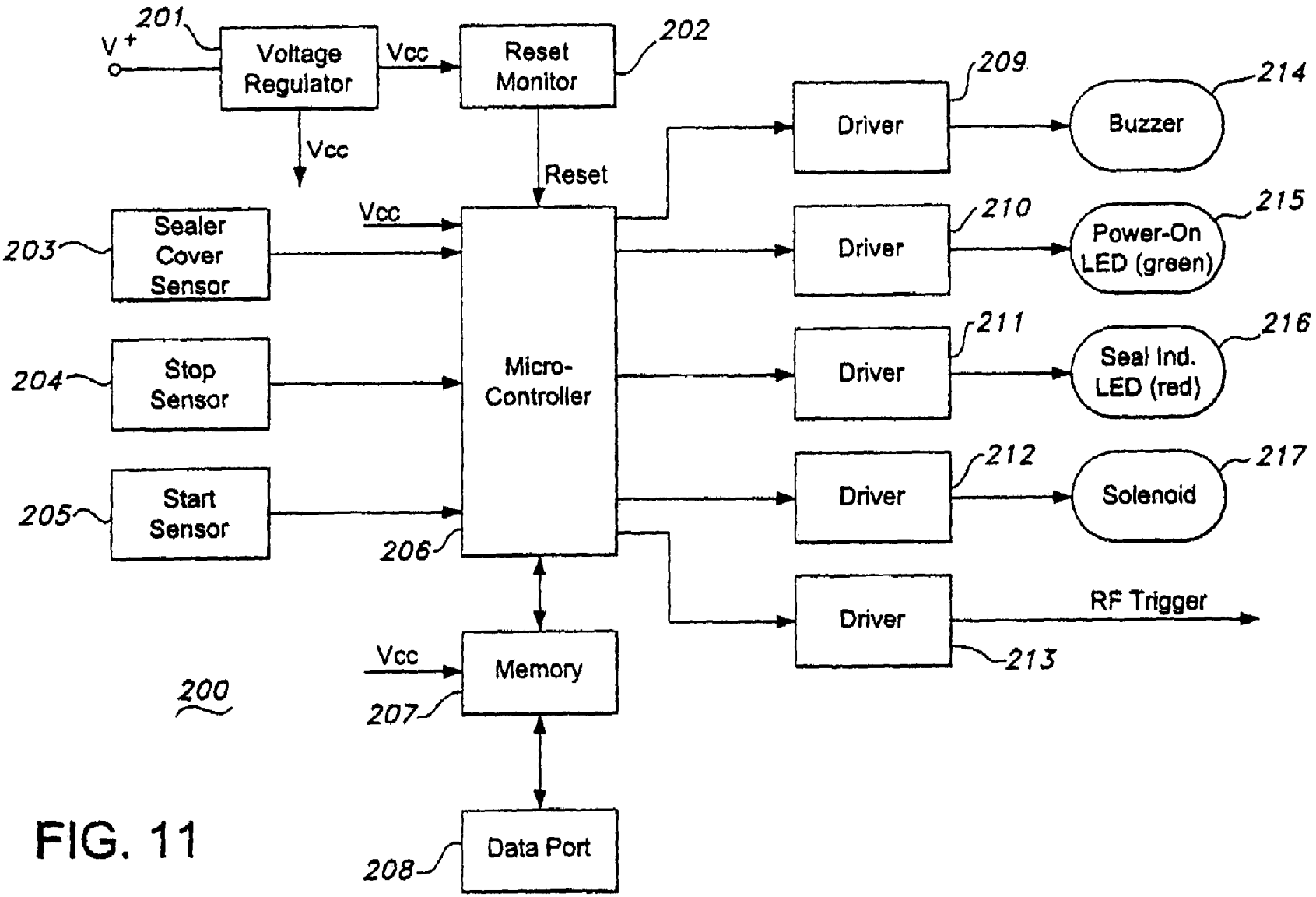
FIG. 11 illustrates a block diagram of an embodiment of a control circuit according to aspects of this invention.

Referring to FIG. 11, an exemplary embodiment of a control circuit, generally designated as 200, will now be described.

Control circuit 200 is adapted for monitoring and controlling the tube sealing operation. The control circuit may also provide status and alerts to the operator (or user). As shown, the heart of the control circuit is microcontroller 206, and, for example, may be AVR microcontroller ATtiny 28L. In the embodiment shown, microcontroller 206 monitors sealer cover sensor 203, stop sensor 204 and start sensor 205. In response to these sensors and in response to a programmed method of operation, microcontroller 206 activates buzzer 214, power on LED (green) 215, seal indicator LED (red) 216, solenoid 217 and RF trigger output to the RF amplifier board. Each of these elements may be activated by way of respective drivers 209-213. Of course, a driver may be omitted, if the microcontroller is capable of directly driving the element.

As shown, microcontroller 206 is coupled to memory 207, which may be an EEPROM, such as FM 25160, and is capable of providing over a billion write operations. One such write operation may include microcontroller 206 storing "good/bad seal" status into memory 207. Another write operation may include storing the modes of operation. Also included may be data port 208 for allowing the user to access memory 207 and obtain status information of a sealing operation.

Control circuit 200 may also include voltage regulator 201 and reset monitor 202. As shown, voltage regulator 201 regulates the V+voltage (for example 13.8 V) and provides Vcc voltage to both the microcontroller and the memory. Reset monitor 202 may also be included to continuously monitor the Vcc voltage from regulator 201. If the voltage drops below a threshold (for example 4.68 V), microcontroller 206 may be reset by monitor 202.

Describing next the sensor signals provided to the microcontroller, there is shown sealer cover sensor 203, which may be a Hall sensor adapted to sense magnetic fields emanating from a pole magnet 46 disposed on the cover or shield 12. It will be appreciated that the placement of the Hall sensor may be such that if the magnetic fields are absent (or below a threshold), the Hall sensor may effectively alert the microcontroller that the sealer cover is not in a shielding position. In response to the Hall sensor alert, the microcontroller may be programmed to prevent activating the solenoid and the RF trigger signal.

Start sensor 205 may include a combination of a transistor and a photodiode for sensing that the tube is in proper position for sealing. It will be appreciated that the microcontroller may be programmed to prevent activation of the solenoid and the RF energy until the tube is in proper position. In the example shown, start sensor 205 senses an absence of light that results from depression of a lever 33 after the tube has been placed in position. Depression of the lever 33, in turn, raises a flag that blocks the light from reaching the photodiode. Blockage of the light may turn off the transistor and cause activation of a signal to inform the microcontroller that the tube is in position.

In a similar manner, stop sensor 204 may include a similar combination of transistor and photodiode for sensing that a limit switch is to be activated. Activation of the limit switch may indicate that a preset jaw-gap has been reached (or a predetermined thickness of the seal has been reached). Activation of the limit switch may result from movement of a flag such as flag 28 of ground jaw shaft 24 into position to block light from reaching the photodiode of stop sensor 204. Upon turning off the photodiode, the transistor may also be turned off, thereby providing an output signal to inform the microcontroller of the limit switch having been activated.

Turning next to output signals that may be provided by microcontroller 206, there is shown buzzer 214 that may be activated to alert the user that a step in the method is not successfully completed. For example, if sealing is not successfully completed, the buzzer may be activated. In another embodiment of the invention, the buzzer may be omitted.

Power-on LED (green) 215 may be activated by the microcontroller to alert the user that the sealing unit is turned-on. The power-on LED may also be controlled from the microcontroller to flash on-and-off. The microcontroller may be programmed to cause the LED to flash a predetermined number of times to indicate a mode of operation (there may be, for example, six modes of operation corresponding to delay times, as discussed previously).

Seal indicator LED (red) 216 may be activated by the microcontroller to alert the user that the RF energy and the solenoid is activated. The microcontroller may also be programmed to cause the seal indicator LED to flash, for example, if power to the unit is on and the shield cover 12 is not in position. In addition, the seal indicator LED may be programmed to flash a predetermined number of times to indicate, for example, that the RF energy and solenoid power are off.

Completing the description of control circuit 200, microcontroller 206 may be programmed to energize solenoid 217 (item 20 in FIG. 5). The solenoid may be, for example, a 12 V solenoid energized by way of driver 212. The driver may be a transistor-switch that when activated by the microcontroller places a ground potential at one end of the solenoid (the other end already having a 12 V potential).

Microcontroller 206 may be programmed to generate the RF trigger signal for turning on the RF amplifier. Although shown as having driver 213 in the path between the microcontroller and switching transistor Q6 (FIG. 10), it will be appreciated that the AVR microcontroller ATtiny 28L may drive the transistor without need for a driver.

Exemplary physical spacing among the components shown schematically in FIG. 11 are provided in FIG. 12. The controller board may be positioned within the cabinet or other form of enclosure in such a way that the flags of the start lever and ground jaw correspond to the positions of the optical sensors and such that the position of the Hall sensor corresponds to the shield's magnet. A notch is provided in the insulator 40 at a location corresponding to the magnet 46 of the cover 12 to accommodate the Hall sensor.

A connector (such as connector J1 shown in FIG. 12) can be provided for connection between the dielectric tube sealer 8 and an external computer or monitor. For example, a computer can be connected to the dielectric tube sealer 8 by means of the connector to download or upload information. In one exemplary embodiment, a Personal Digital Assistant (PDA) or other computer, communications, or reading device can be connected to download the counts of failed and successful seals. This count information can be used to monitor the amount of the use of the sealer, to schedule maintenance and calibration of the sealer, etc. Also, the recordation of the count helps to track the number of cycles a unit has completed, diagnose problems with the equipment, determine maintenance needs, and make accountings for billing purposes.

Referring back to FIG. 11, microcontroller 206 may be programmed to output a pulse width modulated (PWM) signal to supply PWM power to solenoid 217. That is, the PWM signal from microcontroller 206 may control a duty cycle of the power supplied to solenoid 217. Solenoid 217 may be, for example, a 12 V or 13 V solenoid and may have a power rating in the range of 30-80 watts, preferably 60 to 70 watts, and a coil of solenoid 217 may have a DC resistance in the range of about 2.0-5.0 Ω. Moreover, the PWM signal may be at a frequency in the range of between about 250 Hz to 5 KHz.

In a typical tube apparatus that does not include such a pulse width modulation operation, the solenoid heats up during continuous usage and the DC resistance increases at a result of such heating resulting in a reduction in current supplied to the solenoid and a corresponding reduction in compression force exerted by the jaws of the typical tube apparatus. Also the coil transfers heat to the plunger which would conduct unwanted heat to the movable ground jaw 26.

By controlling the duty cycle of the PWM power supplied to solenoid 217, heating of solenoid 217 may be controlled (i.e., reduced or substantially eliminated) and instantaneous compression force produced during on cycles may remain substantially constant throughout all tubing operation of the tubing apparatus.

Microcontroller 206 outputs the PWM signal to driver 212. Driver 212 is connected with a DC voltage supply, for example, at Vcc voltage, such that the DC voltage supply switchably energizes solenoid 217 according to the PWM signal from microcontroller 206. That is, driver 212 may be, for example, a switch switchably coupling the DC voltage supply to solenoid 217 such that microcontroller 206 may control the switch (driver 212) according to the PWM signal output from microcontroller 206.

Figure 13:
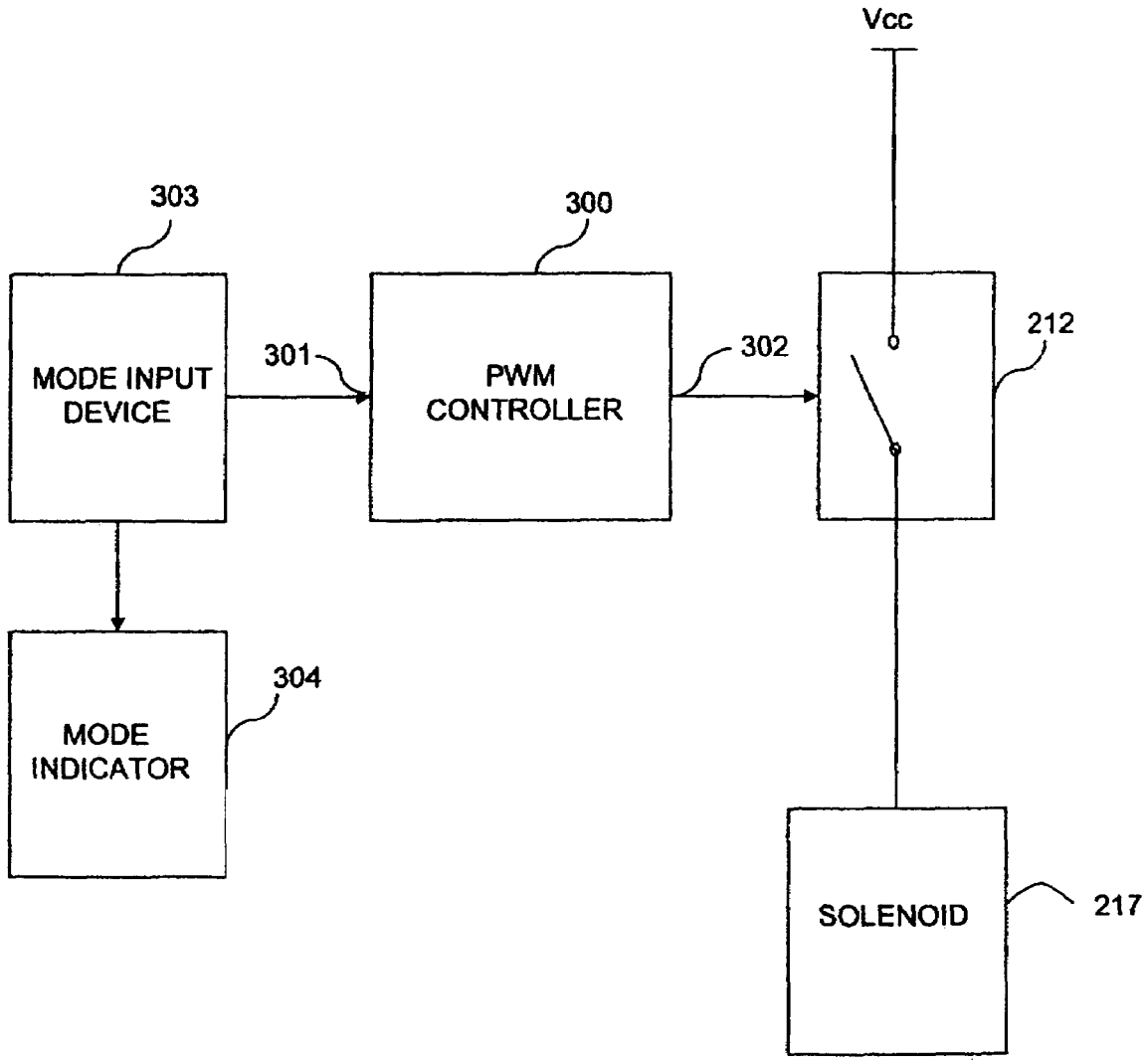
FIG. 13 provides a block diagram for an embodiment of a control unit according to aspects of this invention.
Figure 14:
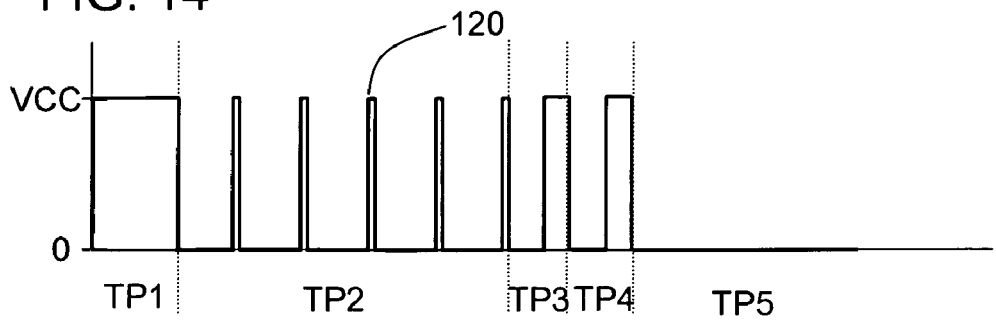
FIGS. 14-17 are timing charts illustrating aspects of an exemplary control method according to aspects of this invention.
Figure 15:
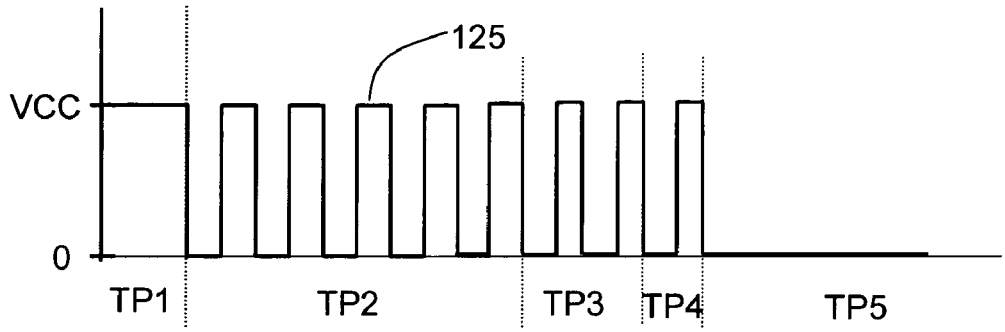
Figure 16:
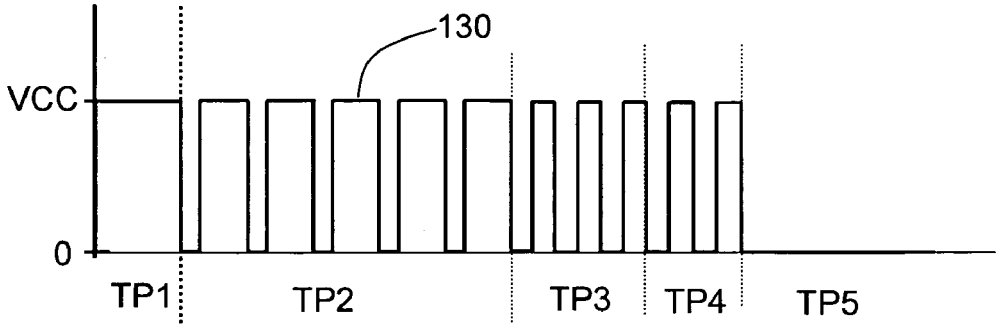
Figure 17:
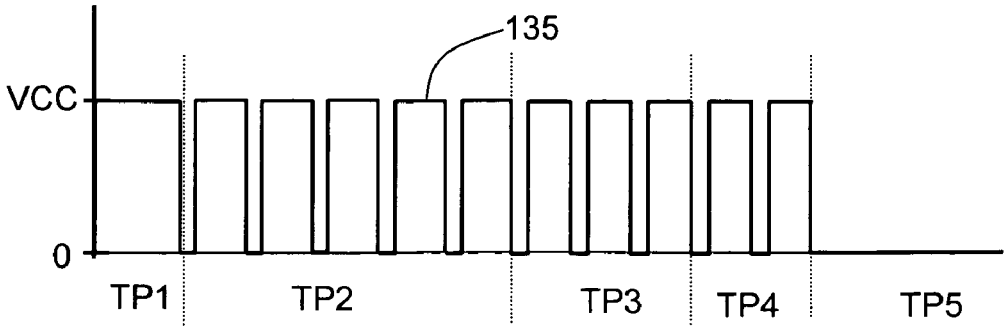

FIG. 13 illustrates an alternative embodiment for duty cycle control of solenoid 217.

Referring to FIG. 13, a pulse width modulation (PWM) controller 300 maybe included in the tube apparatus. PWM controller 300 includes an input terminal 301 and an output terminal 302. Input terminal 301 may be connected to any mode input device 303. Mode input device 303 may provide, for example, an analog voltage proportional to the desired duty cycle. That is, for example, if a 10V signal from mode input device 303 represented a 100% duty cycle, then a 5V signal would represent a 50% duty cycle and soon on. Thus, mode input device 303 may be programmed with the selectable modes, and the selected mode selected by the user may be communicated directly to PWM controller 300 without affecting microcontroller 206. In such a configuration, driver 212 would be coupled to output terminal 302 of PWM controller 300, instead of microcontroller 206. Driver 212 and solenoid 217 have the same functionality previously described. Moreover, a separate mode indicator 304 may be provided, such as an LED indicator, a display device or, otherwise, a wireless connectable device, such as a PDA (i.e., palm pilot) may be used to indicate the selectable modes and the selected mode.

FIG. 14-17 illustrate an exemplary embodiment of four (4) pulse width modulated signals defining four different compression profiles and corresponding delay times defining corresponding heating profiles that are selectable modes by a user. These selectable modes are store in memory and are adjustable according to actual measured compression of the tube portion.

A compression profile refers to establishing one or more periods, each having a successively different duty cycle such that the composite force (i.e., average force for that period) provided by solenoid 217 varies during the one or more periods.

A heating profile refers to establishing one or more periods during which heating (e.g., by radio frequency source) of the tube portion occurs.

Referring to FIGS. 14-17, the output of microcontroller 206 is represented by a control signal 120, 125, 130 or 135. Control signals 120, 125, 130 or 135 corresponding to the duty cycle of solenoid 217 for four (4) different selectable modes (i.e., first through fourth modes). Each control signal 120, 125, 130 or 135 may be a pulse width modulated signal. That is, microcontroller 206 generates a control signal 120, 125, 130 or 135 according to a compression profile, to control the duty cycle of power supplied to solenoid 217 to actuate solenoid 217 and the coupled movable ground jaw 26, thereby compressing the tube portion.

Microcontroller 206 controls the duty cycle of power supplied to solenoid 217 for moving ground jaw 26 to adjust the area of the seal formed in the tube portion during compression and/or thickness T2 of the sealed area. That is, by varying the composite force during the compression operation the area of the seal formed by the compression operation and/or the thickness T2 of the sealed tube portion may be adjusted to produce improved seals.

Moreover, the RF generator 100 may generate heat in the tube portion according to the heating profile simultaneously with the compressing of the tube portion to adjust the area of the seal tube portion and/or the thickness T2 of the sealed tube portion.

In an initial period TP1, a initial duty cycle of the control signal 120, 125, 130 or 135 is 100%. That is, solenoid 217 is fully turned on. The initial period TP1 is for a time period that varies according to the mode selected and is in a range of about 70 to 200 milliseconds. After, initial period TP1 is complete, a heating period TP2 is commenced. The duration of the heating period TP2 is based on activation of the limit switch (i.e., the duration of the heating period TP2 is determined based on a time to produce a measured compression of the tube portion). The duration of the heating period T2 is an indicator of a good tubing operation being accomplished by the tube apparatus. In the heating period TP2, the tube portion is simultaneously heated by RF generator 100 and compressed via solenoid 217. After, the heating period TP2 is complete, a sealing period TP3 is commenced. The duration of the sealing period TP3 varies according to the mode selected and may be in the range of about 0 to 200 milliseconds. In the sealing period TP3, the tube portion is simultaneously heated by the RF generator 100 and compressed via solenoid 217, however, generally, composite compression force (i.e., the average force over the particular period, TP3 in this case) is lower in the sealing period TP3 than in the heating period TP2. That is, the duty cycle of solenoid 217 in the sealing period TP3 is typically less than the duty cycle of solenoid in the heating period TP2. After the sealing period TP3 is complete, a cooling period TP4 is commenced. The duration of the cooling period TP4 varies according to the mode selected and may be in the range of about 0 to 500 milliseconds. In the cooling period TP4, RF generator 100 is stopped and the composite compression force may remain the same as in the sealing period TP3 (i.e., the duty cycle of solenoid 217 remains the same in the heating and cooling periods TP3 and TP4). After, the cooling period TP4 is complete, power to solenoid 217 is stopped (see period TP5).

Microcontroller 206 may simultaneously control both the heating profile (e.g., a radio frequency energy profile) for heating of the tube portion and the compression profile for compressing of the tube portion to adjust the area or the thickness T2 of the sealed tube portion.

During the initial, heating and sealing periods TP1, TP2 and TP3, simultaneously heating and compressing of the tube portion occurs and during the cooling period TP4, only compressing of the tube portion occurs.

Although it is provided that the duration of the heating period TP2 is based on a measure compression of the tube portion by activating the limit switch, it is contemplated that the measurement of compression may be provided by measuring impedance changes across ground and RF jaws 26 and 42.

Although an initial period TP1 is shown, it is contemplated that for particular types of tube portions (for example, very thin walled tube portions) that the initial period TP1 may be eliminated.

For the four (4) exemplary selectable modes (i.e. first through fourth modes), in heating period TP2, the duty cycle of solenoid 217 may be 10%, 50%, 70% and 80%, respectively. For the first to fourth selectable modes, in sealing and cooling periods TP3 and TP4, the duty cycle of solenoid 217 may be 40%, 40%, 48% and 64%, respectively. By providing different selectable modes, the user can select a mode to provide, for example, a particular width W and/or thickness T2 of the sealed tube portion. That is, for a particular tube portion by selecting, for example, the fourth mode a wider sealed tube portion may be realized than, otherwise, if the first mode is selected.

Although in the exemplary selectable modes specific values are provided for duty cycles in the various periods (i.e., the initial period TP1, the heating period TP2, the sealing period TP3 and the cooling period TP4), other duty cycles are possible as long as a good seal can be produced. The preferred ranges for duty cycles in the various periods are as follows: (1) in initial period TP1, the duty cycle of solenoid 217 is desirably in the range of about 90% to 100%; (2) in heating period TP2, the duty cycle of solenoid 217 is desirably in the range of about 10% to 90%; and (3) in third and fourth periods TP3 and TP4, the duty cycle of solenoid 217 is desirably in the range of about 40% to 70%.

Memory 207 may store the plurality of selectable modes in one or more tables. That is, memory 207 may include the one or more tables for storing the heating profiles and the compression profiles corresponding to the selectable modes. For example, for each selectable mode the one or more tables may include the programmed time delay that is used to turn off RF generator 100 after activation of the limit switch second and third duty cycle settings to set the duty cycle of solenoid 217 in the second and third periods TP2 and TP3, respectively, and first, third and fourth duration settings to set the duration of the initial, cooling and sealing periods TP1, TP3 and TP4.

By controlling the duty cycle of solenoid 217, power requirement for sealing the tube portion are reduced. Since power requirements are reduced, solenoid 217 may be configured to reduce or eliminate the affect of heating during heavy (e.g. continuous) usage. Thus, DC resistant of the coil of solenoid 217 may be keep substantially constant such that the instantaneous compression force exerted by movement of ground jaw 26 or the tube portion does not degrade (i.e., is not reduced) over time during heavy usage. If the tube apparatus is operated by battery power or uses a portable generator, this aspect of reducing the power requirements may be especially desirable.

Since nonlinearities in compression force from solenoid 217 exist, it is contemplated that by varying the duty cycle of solenoid 217 that such nonlinearities may be compensated for, thereby producing a compression force from solenoid 217 that is equivalent to a linear compression force. That is, a typical solenoid has the least compression force for a particular input current when solenoid 217 is fully extended and the most compression force for the particular input current when solenoid 217 is fully retracted. Thus, using a varying duty cycle may allow for compensation of this effect to linearize the compression force of solenoid 217.

Microcontroller 206 or memory 207 may include program code stored therein for uses by microcontroller 206 to control the tube apparatus, the program code may include a program code segment for controlling the duty cycle of solenoid 217 according to the compression profile to compress the tube portion, thereby controlling the area of the seal formed in the tube portion and or thickness T2 of the sealed tube portion.

It is contemplated that the methods previously described may be carried out within microcontroller 206 or a general purpose computer system instructed to perform these functions by means of a computer-readable medium. Such computer-readable media include; integrated circuits, magnetic and optical storage media, as well as audio-frequency, radio frequency, and optical carrier waves.

A plurality of user selectable modes which each may be defined by the heating profile, for example, the programmed delay time for turning off RF generator 100 and the compression profile, for example, the duty cycles of power supplied to solenoid 217, may be programmed into microcontroller 206. That is, the selectable modes set the delay time to shut off RF generator 100 after activation of the limit switch (for example, as shown in FIGS. 8*a* and 8*b*), and, furthermore, set, for example, the duty cycle of solenoid 217.

Figure 18A:
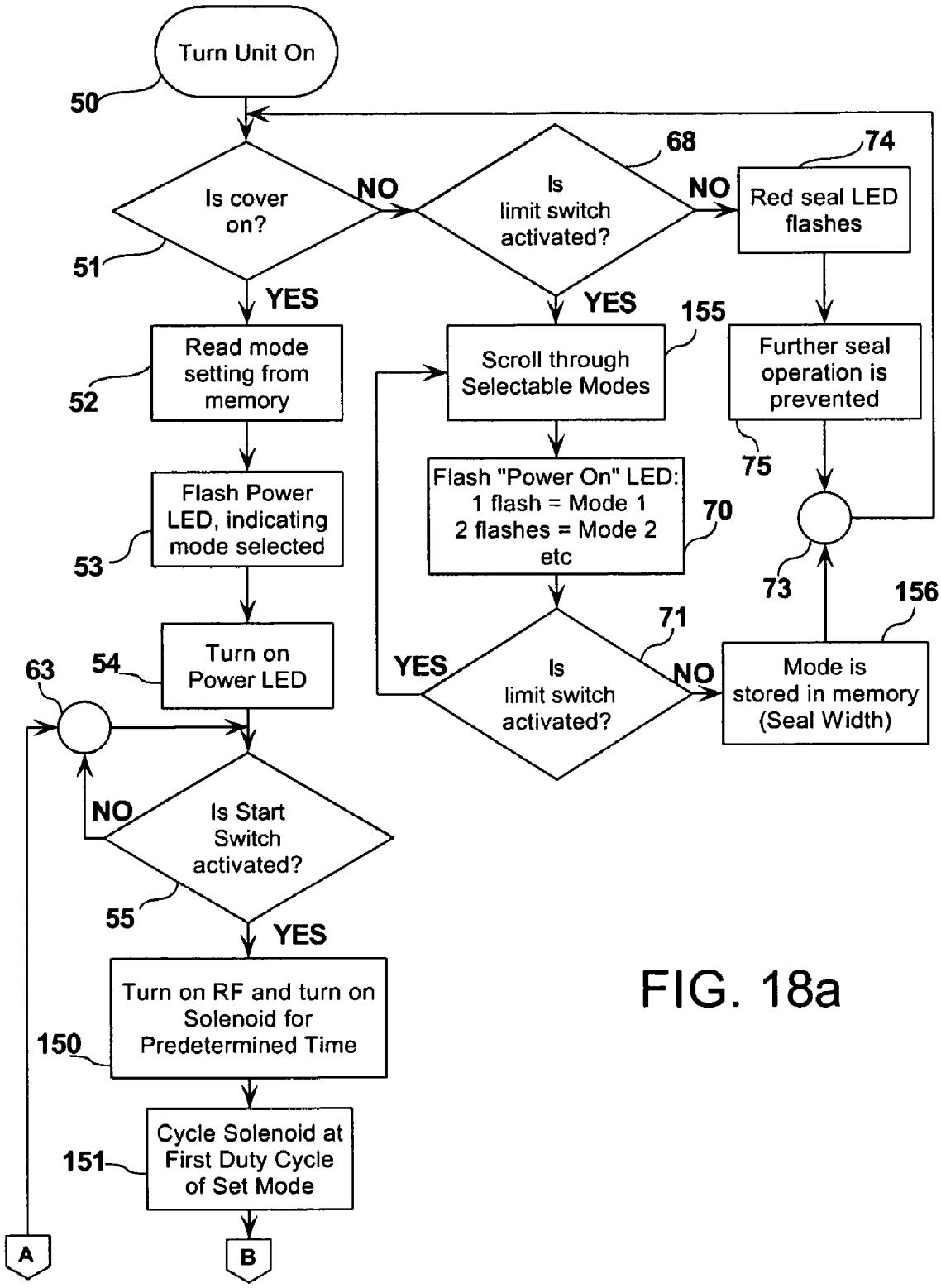
FIGS. 18*a* and 18*b* provide a flow diagram illustrating the use of an embodiment of a tube apparatus according to aspects of this invention.
Figure 18B:
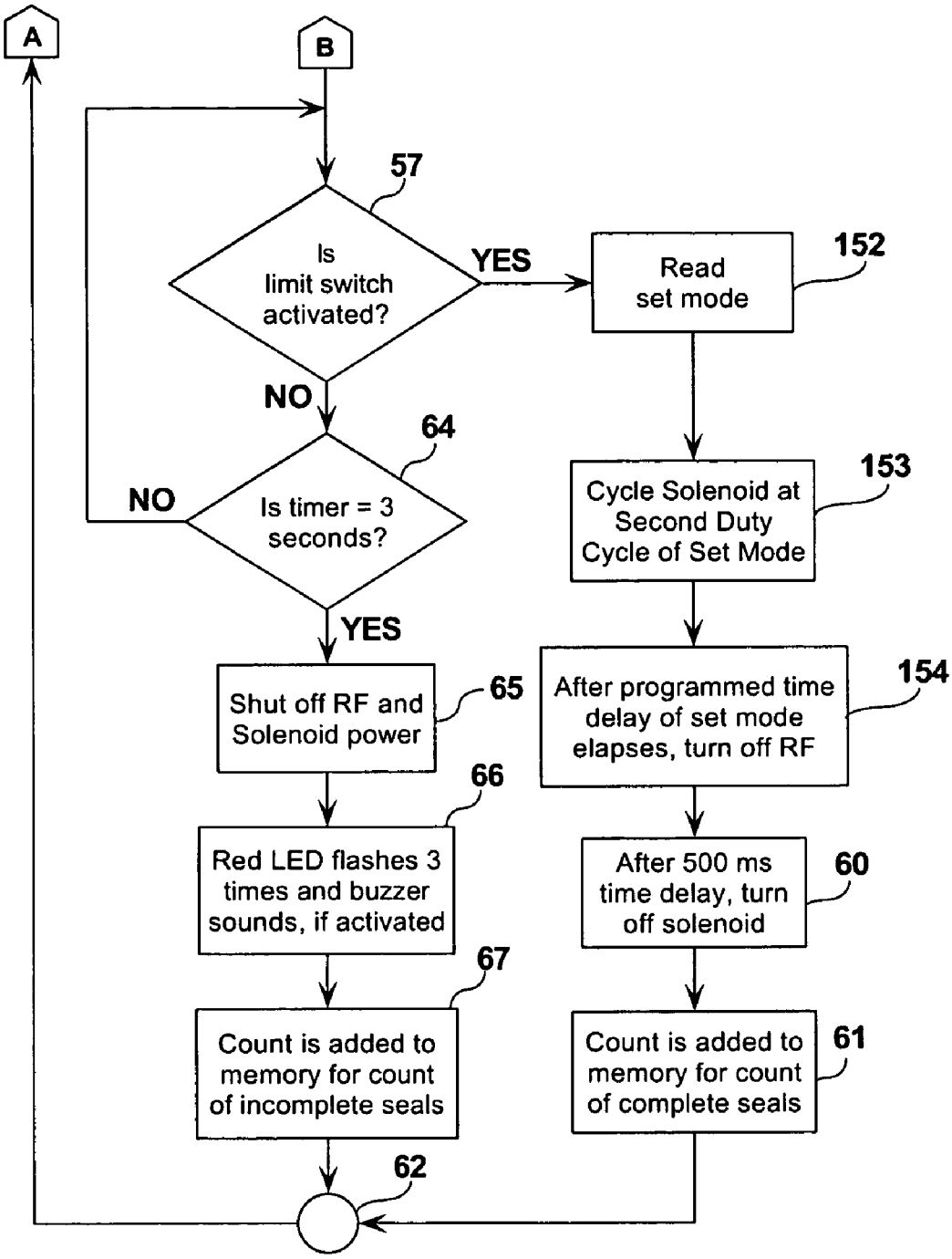

FIGS. 18*a* and 18*b* which illustrate a flow diagram showing operation of an exemplary embodiment of a tube apparatus according to this invention will now be described.

Now referring to FIGS. 18*a* and 18*b*, for brevity, only a brief review of steps which are common with those of FIGS. 8*a* and 8*b* will be included below.

Steps 64-67 which illustrate exemplary operation of the system in connection with a failed seal and steps 74 and 75 which illustrate an exemplary inoperable mode are common between this embodiment and that covered in FIGS. 8*a* and 8*b* and will not be further discussed. Steps 50-55, 57, 61-63, and 151-154 roughly correspond to another exemplary sealing operation of the apparatus. Further, steps 68, 70-71, 73, and 155 and 156 illustrate another exemplary programming mode.

Referring first to the exemplary sealing operation illustrated in steps 50-55, 57, 61-63, and 151-154 of FIGS. 18*a* and 18*b*, steps 50-55 are common between this embodiment and that covered in FIGS. 8*a* and 8*b* and will not be further discussed.

After step 55 is complete, if the start switch has been activated, RF generator 100 (and red seal LED) may be turned on and solenoid 217 may be turned on (i.e., having a 100% duty cycle) for a predetermined time in step 150. That is, RF generator 100 may be turned on and may remain on until the limit switch is activated or until an overall time period for making a seal elapse causing an indication of an unsuccessful seal (see steps 64 and 65 of FIGS. 18*a* and 18*b*) and solenoid 217 may be turned on for a predetermined time in the range of about 0 to 200 milliseconds. By turning solenoid 217 on initially, a maximum force is applied to compress the tube portion when ground and RF jaws 26 and 42 are fully extended. This compensates for an affect that as solenoid 217 is extend the compression force produced by solenoid 217 is reduced for a constant input current level. After the predetermined time is completed, solenoid 217 is duty cycled (i.e., cycled on and off at a switching frequency in the range of about 250 Hz to 5 KHz) at a first duty cycle that is between about 10% and 90% according to the mode selected by the user in step 151. Step 57 queries whether the limit switch is activated. If so, the programmed time delay of the selected mode is read in step 152. In step 153, solenoid 217 is duty cycled at a second duty cycle that is between about 40% and 64% according to the mode selected by the user. RF generator 100 is turned off after the programmed time delay of the set mode elapses in step 154. After a predetermined time (e.g., 500 ms), which may be selected based on the amount of time desired for the seal to cool adequately, solenoid 217 (and red seal LED) is turned off in step 60, and a count is added to memory 207 for an updated count of complete seals in step 61. The successful seal is then completed in step 62 and the apparatus can then be readied to create another seal at step 63.

Referring now to the exemplary programming mode in steps 68, 70, 71, 73, 155 and 156, if the cover is off (step 51) and the limit switch or stop sensor 204 is activated (step 68) during apparatus start up, then the apparatus scrolls through a menu of available modes in step 155. Accordingly, the programming mode in steps 68, 70, 71, 73, 155 and 156 is initiated by: (1) removing the cover 12, (2) either using start lever 33 to activate the limit switch or, otherwise, pushing ground jaw 26 in to activate the limit switch, (3) turning the apparatus on, and (4) selecting a mode. In step 70, the power LED can flash as an indicator of a variety of selectable modes and/or an audible alarm mode. This embodiment includes four (4) modes available for selection. Each of these modes control both the timing of RF generation and the duty cycle of solenoid 217 during the sealing process of the tube portion received in the apparatus.

Program mode is initiated when the shield 12 is off, the limit switch is activated, and the power is then turned on. If the cover or shield is removed after power up and the limit switch is triggered, the apparatus will not enter program mode.

For example, one flash may correspond to a particular mode with a particular heating profile (e.g., a delay time to turn off RF generator 100 after the limit switch is activated) and a particular compression profile (e.g., a first duty cycle for cycling solenoid 217 after a full on predetermined period and a second duty cycle for cycling solenoid 217 after the limit switch is activated for another predetermined period).

The user can activate the limit switch (step 68) by: either using start lever 33 to activate the limit switch or, otherwise, pushing in ground jaw shaft 24 or ground jaw 26 while the cover is off. While in the programming mode, the apparatus will continue to scroll through the menu of possible modes until the limit switch is deactivated at step 71. In other words, if the limit switch remains activated (e.g., by the user retaining ground jaw shaft 24 in a closed position) then the apparatus will continue to scroll selectable modes. Upon release of ground jaw shaft 24 by the user, the limit switch will thereby be deactivated in step 71 and the mode selected by the user by deactivating the limit switch is then stored in the memory 207 as the selected mode in step 156.

The various programmed modes may determine the heating and compression profiles and/or the nature of the indicator with respect to failed and successful seals. For example, a menu of program modes can include modes configured to sound an audible alarm (e.g., a buzzer) in the event of a failed seal. Alternatively, modes can dictate a silent, visual alarm depending on the preferences of the end user.

As indicated in step 155, the mode selected by the user will correlate to a desired seal width. Generally, the longer the delay time (i.e., prior to turning off RF generator 100) and the larger the duty cycles of solenoid 217 (i.e., the higher the composite compression action of solenoid 217), the wider the seal may be. After step 155, the programming mode is concluded at step 73.

Although in the embodiment shown includes four (4) user selectable modes, it is contemplated that any number of other user selectable modes may be implemented.

Although in the embodiment shown the user selectable modes are preprogrammed (i.e., user selectable according to a scrolled menu), it is contemplated that an input device, such as a touch pad may be implemented to input setting to microcontroller 206 to set the mode according to unique requirements of the user by allowing the user to adjust any number of parameters established in a preprogrammed selectable mode or, otherwise, to establish a new mode for selection.

Although exemplary embodiments of a tube sealer and method according to this invention have been described, there are others that support the spirit of the invention and are therefore within the contemplated scope of the invention. For example, although the dielectric tube sealer 8 is embodied as a tabletop unit, the jaw components of the system, and optionally the entire system, can be reconfigured as a hand-held unit to improve upon its portability. Also, the configuration of the jaws with respect to the cabinet can be modified. More specifically, although the jaws are shown to be extending outwardly from a cabinet 10 and covered by an external shield 12, the jaws can be positioned entirely within the interior of a cabinet so long as access to the jaws can be provided for the insertion of a tube portion between them.

Although the invention has been described with reference to tube sealers to illustrate exemplary features of the invention, this invention applies with equal benefit to all tube apparatus, whether such apparatus are used to seal, connect, weld, join, cut, or otherwise alter or manipulate tubing. For example, exemplary features of this invention can be applied to sterile tube welders or connection devices such as those used in blood bank or blood center applications.

The foregoing is considered as illustrative only of the many possible variations in the illustrated configurations of the invention, and the foregoing recitation of variations should not be considered to be an exhaustive list. It will be appreciated, therefore, that other modifications can be made to the illustrated embodiment without departing from the scope of the invention. The scope of the invention is separately defined in the appended claims.

What is claimed:

1. A tube apparatus configured to perform a tube operation on a tube portion, said apparatus comprising:

tube-contacting surfaces spaced from one another to receive the tube portion, at least one of said tube-contacting surfaces being movable with respect to another one of said tube-contacting surfaces to compress the tube portion;

means for moving said at least one movable tube-contacting surface; and means for controlling a duty cycle of the moving means according to a compression profile of the moving means.

2. The tube apparatus according to claim 1, wherein the tube operation is selected from the group consisting of a seal, a weld, a connection, and a severance.

3. The tube apparatus according to claim 1, wherein the tube-contacting surfaces include at least one fixed surface such that the tube portion is compressed between the at least one movable surface and the at least one fixed surface.

4. The tube apparatus according to claim 3, wherein the at least one movable surface and the at least one fixed surface move with respect to each other such that the at least one movable surface and the at least one fixed surface are spaced apart in a first position to receive the tube portion and the at least one movable surface and the at least one fixed surface are proximal to each other in a second position to compress the tube portion, the tube apparatus further comprising;

a sensor configured to detect when the at least one movable surface moves to the second position.

5. The tube apparatus according to claim 4, wherein:

one of the at least one movable surface or the at least one fixed surface is coupled to a source of radio frequency energy to heat the tube portion that is in the space between the surfaces; and the controlling means controls an amount of time the radio frequency energy is provided to the tube portion for heating the tube portion according to when the at least one movable surface reaches the second position.

6. The tube apparatus according to claim 4, wherein:

one of the at least one movable surface or the at least one fixed surface is coupled to a source of radio frequency energy to heat the tube portion that is in the space between the surfaces; and the controlling means simultaneously controls a radio frequency energy profile for heating of the tube portion and the compression profile for compressing of the tube portion to adjust an area of a seal formed in a tube portion or a thickness of the tube portion at the area of the seal.

7. The tube apparatus according to claim 1, further comprising:

a direct current voltage source; and a switch coupling the direct current voltage source to the moving means, wherein the controlling means controls the switch according to a control signal output from the controlling means.

8. The tube apparatus according to claim 7, wherein the control signal output from the controlling means is a pulse width modulated signal to pulse width modulate voltage to the moving means.

9. The tube apparatus according to claim 1, wherein the controlling means includes a plurality of modes selectable by a user that are defined by the compression profile and a heating profile to be applied to the tube portion.

10. The tube apparatus according to claim 9, further comprising:

a memory for storing the plurality of selectable modes; and an indicator configured to signal a selected mode from among the plurality of selectable modes.

11. The tube apparatus according to claim 10, wherein the indicator is selected from a visual indicator and/or an audible indicator.

12. The tube apparatus according to claim 1, wherein the controlling means controls a duty cycle of power supplied to the moving means for moving the at least one movable surface to adjust an area of a seal formed in the tube portion during compression and/or a thickness of the sealed area.

13. The tube apparatus according to claim 1, wherein the compression profile includes a plurality of periods, each respective period having a successively different duty cycle such that a composite force for the respective period varies relative to other respective periods of the plurality of periods.

14. The tube apparatus according to claim 1, wherein the means for moving said at least one movable tube-contacting surface is a compression means such that the means for controlling the duty cycle controls compression of the tube portion.

15. A tube sealer to control a size of a seal formed in a tube portion, said tube sealer comprising:

a plurality of jaws mounted for movement with respect to each other, at least one of the jaws being coupled to an energy source to heat the tube portion;

a solenoid coupled to a respective one of the jaws to move the respective one of the jaws to compress the tube portion; and a microprocessor configured to control the energy source and the solenoid, the microprocessor being programmable to select one or more periods during which heating of the tube portion is performed by the energy source and to select one or more compression periods, successive compression periods having a different duty cycle to supply power to the solenoid to adjust a compression action of the solenoid, thereby controlling the size of the seal formed in the tube portion.

16. The tube sealer according to claim 15, wherein the plurality of jaws are positioned between (1) a first position spaced apart from each other to receive the tube portion and (2) a second position proximal to each other to compress the tube portion, the tube sealer further comprising;

a sensor configured to detect when one of the plurality of jaws reach the second position.

17. The tube sealer according to claim 15, wherein the microprocessor controls the time period or time periods for heating the tube portion and varies a duty cycle of power supplied to the solenoid.

18. The tube sealer according to claim 15, wherein the microprocessor is programmed with a plurality of modes selectable by a user, each mode including at least one of a different time period or time periods for heating the tube portion and/or a different duty cycle of power supplied to the solenoid.

19. A tube apparatus configured to perform a tube operation on a tube portion, said tube apparatus comprising:

tube-contacting surfaces spaced from one another to receive the tube portion, at least one of said tube-contacting surfaces being movable with respect to another one of said tube-contacting surfaces to compress the tube portion;

an actuator coupled to said at least one movable tube-contacting surface; and a controller coupled to said actuator for controlling a duty cycle of said actuator according to a compression profile of the actuator.

20. A method of controlling a tube apparatus configured to seal, weld or sever a tube portion, the tube apparatus including tube-contacting surfaces spaced from one another to receive the tube portion, at least one of said tube-contacting surfaces being movable with respect to another one of said tube-contacting surfaces to compress the tube portion, and an actuator coupled to said at least one movable tube-contacting surface, the method comprising the step of:

controlling a duty cycle of an actuator according to a compression profile of the actuator to compress the tube portion and to control an area of a seal formed in the tube portion and/or a thickness of the sealed tube portion.

21. The method according to claim 20, wherein the step of controlling the duty cycle comprises:

generating a control signal, according to the compression profile, for controlling a duty cycle of power supplied to the actuator to actuate the actuator and the coupled at least one movable tube-contacting surface, thereby compressing the tube portion.

22. The method according to claim 21, wherein the step of generating the control signal is generating a pulse width modulated signal.

23. The method according to claim 21, further comprising the step of:

generating heat in the tube portion according to a heating profile simultaneously with the compressing of the tube portion to adjust the area of the seal formed in the tube portion and/or the thickness of the sealed tube portion.

24. The method according to claim 23, wherein the step of generating heat in the tube portion is by generating radio frequency heating in the tube portion.

25. The method according to claim 23, further comprising the steps of:

storing in a memory a plurality of selectable modes defining the compression profile and the heating profile to be applied to the tube portion; and selecting, responsive to a desire of a user, one of the plurality of modes.

26. The method according to claim 25, further comprising the steps of:

determining whether the coupled at least one movable tube-contacting surface reaches a predetermined position, wherein the step of controlling the duty cycle of the actuator comprises the step of:

controlling the duty cycle of power supplied to the actuator according to the mode selected by the user and whether the coupled at least one movable tube-contacting surface is determined to have reached the predetermined position.

27. The method according to claim 26, further comprising the step of:

controlling a period for the generation of heat in the tube portion according to whether the coupled at least one movable tube-contacting surface is determined to have reached the predetermined position.

28. The method according to claim 25, further comprising the step of:

determining when the coupled at least one movable tube-contacting surface reaches a predetermined position, wherein the step of controlling the duty cycle of the actuator comprises the step of:

simultaneously controlling a radio frequency energy profile for heating the tube portion and the compression profile for compressing the tube portion to adjust the area of the seal formed in the tube portion and/or the thickness of the sealed tube portion.

29. A method of controlling a tube sealer configured to seal a tube portion, the tube sealer having a heat source to selectively heat the tube portion and an actuator configured to compress the tube portion via at least one movable tube-contacting surface, the method comprising the steps of:

selecting one mode of a plurality of selectable modes of operating the tube sealer, each of the modes having heating and compression profiles, the heating and compression profiles defining heating periods of the heat source for heating the tube portion and duty cycles of the actuator for compression of the tube portion, respectively; and during a plurality of periods defined by the selected mode, simultaneously heating and compressing the tube portion according to the heating and compression profiles of the selected mode.

30. The method according to claim 29, wherein:

the plurality of period is first through fifth periods such that (1) durations of the first and fifth periods are predetermined, (2) a duration of the second period is determined based on a time to produce a measured compression of the tube portion, and (3) a duration of the third and fourth periods are determined based on the selected mode.

31. The method according to claim 30, wherein the duty cycle of the actuator (1) in the first period is in the range of about 90% to 100%, (2) in the second period is in the range of about 10% to 90%, and (3) in the third and fourth periods is in the range of about 40% to 70%.

32. A method of controlling a tube sealer configured to seal a tube portion, the tube sealer having a heating source to selectively heat the tube portion and an actuator configured to compress the tube portion, compression by the actuator being controlled according to a duty cycle of the actuator, the method comprising the step of:

simultaneously heating and compressing the tube portion according to a mode selected by a user, each mode including a heating profile and a compression profile, the heating and compressing of the tube portion being adjusted based on a time to produce a measured compression of the tube portion.

* * * * *

UNITED STATES PATENT AND TRADEMARK OFFICE

CERTIFICATE OF CORRECTION

PATENT NO. : 7,326,898 B2
APPLICATION NO. : 10/971901
DATED : February 5, 2008
INVENTOR(S) : John W. Dozier It is certified that error appears in the above-identified patent and that said Letters Patent is hereby corrected as shown below:

Please delete the Title in its entirety and replace it with the text below:

--TUBE CLOSING APPARATUS AND METHOD USING A COMPRESSION PROFILE TO PROVIDE A CONTROLLED CLOSURE FORCE--

Please delete the Abstract in its entirety and replace it with the text below:

--A method and apparatus for performing a tube operation on a tube portion is provided. The tube apparatus including tube-contacting surfaces spaced from one another to receive the tube portion, at least one of the tube-contacting surfaces being movable with respect to another one of the tube-contacting surfaces to compress the tube portion, an actuator coupled to the at least one movable tube-contacting surface, and a controller coupled to the actuator for controlling a duty cycle of the actuator according to a compression profile of the actuator. The method providing control of the duty cycle of the actuator according to the compression profile of the actuator to compress the tube portion and to control an area of the seal formed in the tube portion and/or a thickness of the sealed tube portion.--

At column 1, lines 1-3 please replace the Title with the text below:

--TUBE CLOSING APPARATUS AND METHOD USING A COMPRESSION PROFILE TO PROVIDE A CONTROLLED CLOSURE FORCE--

UNITED STATES PATENT AND TRADEMARK OFFICE

CERTIFICATE OF CORRECTION

PATENT NO. : 7,326,898 B2
APPLICATION NO. : 10/971901
DATED : February 5, 2008
INVENTOR(S) : John W. Dozier It is certified that error appears in the above-identified patent and that said Letters Patent is hereby corrected as shown below:

Please delete FIGS. 1 and 2 from the Letters Patent and replace them with FIGS. 1a, 1b and 2 as shown below:

FIG. 1a

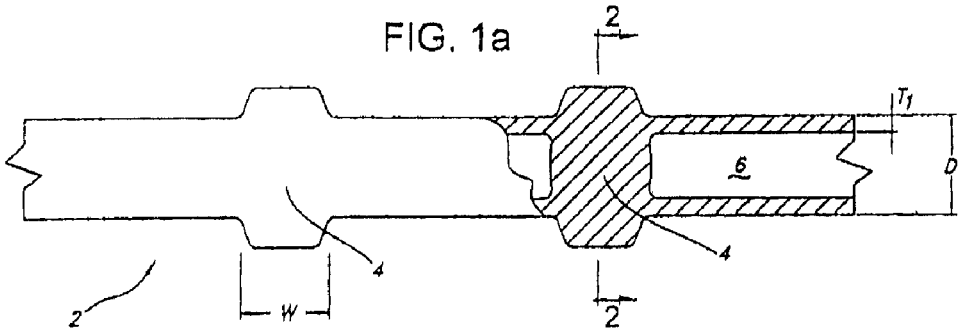

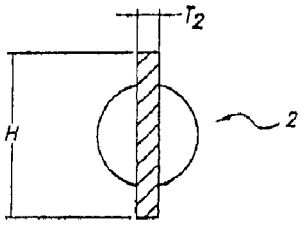

FIG. 2

UNITED STATES PATENT AND TRADEMARK OFFICE

CERTIFICATE OF CORRECTION

PATENT NO. : 7,326,898 B2
APPLICATION NO. : 10/971901
DATED : February 5, 2008
INVENTOR(S) : John W. Dozier It is certified that error appears in the above-identified patent and that said Letters Patent is hereby corrected as shown below:

FIG. 1b

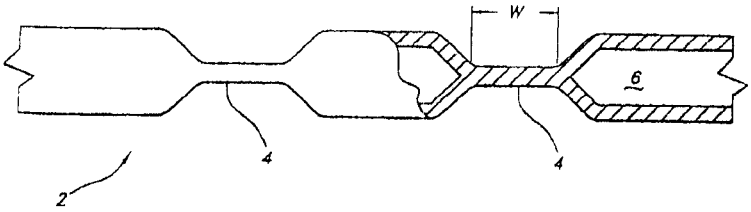

Signed and Sealed this

Eighth Day of July, 2008

JON W. DUDAS
*Director of the United States Patent and Trademark Office*